US010513115B2

(12) United States Patent
Chikamoto et al.

(10) Patent No.: US 10,513,115 B2
(45) Date of Patent: Dec. 24, 2019

(54) LIQUID EJECTING HEAD AND LIQUID EJECTING APPARATUS

(71) Applicant: SEIKO EPSON CORPORATION, Tokyo (JP)

(72) Inventors: Motonori Chikamoto, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/919,677

(22) Filed: Mar. 13, 2018

(65) Prior Publication Data

US 2018/0272710 A1 Sep. 27, 2018

(30) Foreign Application Priority Data

Mar. 23, 2017 (JP) ..... 2017-057639

(51) Int. Cl.
*B41J 2/14* (2006.01)
*B41J 2/18* (2006.01)

(52) U.S. Cl.
CPC ..... *B41J 2/14201* (2013.01); *B41J 2/18* (2013.01); *B41J 2002/14491* (2013.01)

(58) Field of Classification Search
CPC ..... B41J 2/18; B41J 2/14201; B41J 2/14233; B41J 2002/14419; B41J 2202/18; B41J 2002/14241; B41J 2002/14491
See application file for complete search history.

(56) References Cited

U.S. PATENT DOCUMENTS

2006/0290747 A1 12/2006 Shimada et al.
2008/0238980 A1 10/2008 Nagashima et al.
2011/0242237 A1* 10/2011 Uezawa ..... B41J 2/14233 347/89

FOREIGN PATENT DOCUMENTS

CN 1856403 A 11/2006
EP 2783857 A2 10/2014
JP 2014-051008 A 3/2014

OTHER PUBLICATIONS

The Extended European Search Report for the corresponding European Patent Application No. 18163232.4 dated Oct. 26, 2018.

* cited by examiner

*Primary Examiner* — Geoffrey S Mruk
(74) *Attorney, Agent, or Firm* — Global IP Counselors, LLP

(57) ABSTRACT

A liquid ejecting head includes an ejecting section including a pressure chamber filled with liquid, a communicating flow channel communicating with a nozzle which ejects the liquid filling the pressure chamber, and a piezoelectric element driven with a drive signal, a circuit substrate provided above the ejecting section, a switch circuit which is provided on the circuit substrate, and a reserve chamber which reserves the liquid to be supplied to the pressure chamber. The piezoelectric element is provided in a sealed space defined by a plurality of members including the circuit substrate, the pressure chamber includes an inlet port allowing the liquid within the reserve chamber to flow into the pressure chamber, an outlet port allowing the liquid within the pressure chamber to flow to the reserve chamber, and a supply port allowing the liquid within the pressure chamber to be supplied to the communicating flow channel.

16 Claims, 17 Drawing Sheets

LIQUID EJECTING HEAD AND LIQUID EJECTING APPARATUS

This application claims priority to Japanese Patent Application No. 2017-057639 filed on Mar. 23, 2017. The entire disclosure of Japanese Patent Application No. 2017-057639 is hereby incorporated herein by reference.

BACKGROUND

1. Technical Field

The present invention relates to a technique to eject liquid such as ink.

2. Related Art

Liquid ejecting heads have been proposed which eject liquid, such as ink, through nozzles to form images on recording media. For example, JP-A-2014-051008 discloses a liquid ejecting head including: a piezoelectric element which is driven by a drive signal; a pressure chamber which is filled with liquid inside and changes internal pressure in accordance with the drive by the piezoelectric element; a nozzle which communicates with the pressure chamber and ejects the liquid filling the pressure chamber, in accordance with the change in the pressure within the pressure chamber; and an integrated circuit, such as a switch circuit, which switches between supply and shut-off of the drive signal to the piezoelectric element.

The aforementioned drive signal has a large amplitude. Supplying the drive signal therefore causes the switch circuit to generate heat. Specifically, the switch circuit increases in temperature when supplying the drive signal to the piezoelectric element. When the temperature of the switch circuit increases and exceeds the upper limit operating temperature of the switch circuit, the switch circuit sometimes fails to operate stably.

In a liquid ejecting head which includes nozzles arranged at high density in order to form an image with a resolution of 300 dots per inch (dpi) or higher, for example, the switch circuit needs to be highly integrated. The increase in temperature of the switch circuit becomes a more major problem due to an increase in the amount of current per unit area, an increase in impedance due to miniaturization of the switch circuit, reduction in heat exhausting performance due to integration, and the like. In some cases, the switch circuit is provided within the liquid ejecting head, which is close to the piezoelectric element, in order to drive the liquid ejecting head including nozzles arranged at a high density without being much influenced by external noise and the like, for example. In such a case, the switch circuit is exposed to the air outside of the liquid ejecting head through a small area, making it difficult to efficiently dissipate heat generated from the switch circuit. The switch circuit therefore tends to relatively increase in temperature. In the above-described cases, the operation of the switch circuit is more likely to be unstable due to the increase in temperature of the switch circuit beyond the upper limit operating temperature thereof.

SUMMARY

An advantage of some aspects of the invention is provision of the technique concerning a liquid ejecting head including a switch circuit to reduce the likelihood that the switch circuit becomes hot.

A liquid ejecting head according to an aspect of the invention includes: an ejecting section including: a pressure chamber filled with liquid; a communicating flow channel communicating with a nozzle which ejects the liquid filling the pressure chamber; a vibration plate constituting the wall surface of the pressure chamber; and a piezoelectric element driven with a drive signal; a circuit substrate provided above the ejecting section; a switch circuit which is provided on the circuit substrate and switches between supply and shut-off of the drive signal to the piezoelectric element; and a reserve chamber which reserves the liquid to be supplied to the pressure chamber, in which the piezoelectric element is provided in a sealed space defined by a plurality of members including the circuit substrate and the ejecting section, the pressure chamber includes: an inlet port allowing the liquid within the reserve chamber to flow into the pressure chamber; an outlet port allowing the liquid within the pressure chamber to flow to the reserve chamber; and a supply port allowing the liquid within the pressure chamber to be supplied to the communicating flow channel, and at least when the piezoelectric element is driven, in the pressure chamber, the liquid flows from the inlet port to at least one of the outlet port and the supply port.

According to the aforementioned aspect, the circuit substrate on which the switch circuit is provided is located above the ejecting section. This allows heat generated in the switch circuit to be efficiently dissipated through the liquid flowing from the inlet port to the outlet port or the supply port. According to the aspect, therefore, the likelihood that the switch circuit becomes hot is lower than that in the case where the pressure chamber does not include the outlet port.

A liquid ejecting head according to an aspect of the invention includes: an ejecting section including: a pressure chamber filled with liquid; a communicating flow channel communicating with a nozzle which ejects the liquid filling the pressure chamber; a vibration plate constituting the wall surface of the pressure chamber; and a piezoelectric element driven with a drive signal; a circuit substrate provided above the ejecting section; a switch circuit which is provided on the circuit substrate and switches between supply and shut-off of the drive signal to the piezoelectric element; and a reserve chamber which reserves the liquid to be supplied to the pressure chamber, in which the piezoelectric element is provided in a sealed space defined by a plurality of members including the circuit substrate and the ejecting section, the pressure chamber includes: an inlet port allowing the liquid within the reserve chamber to flow into the pressure chamber; and a supply port allowing the liquid within the pressure chamber to be supplied to the communicating flow channel, the communicating flow channel is provided with an outlet port allowing the liquid within the communicating flow channel to flow to the reserve chamber, and at least when the piezoelectric element is driven, the liquid flows from the inlet port to at least one of the outlet port and the nozzle via the supply port and the communicating flow channel.

According to the aforementioned aspect, the circuit substrate on which the switch circuit is provided is located above the ejecting section. This allows heat generated in the switch circuit to be efficiently dissipated through the liquid flowing from the inlet port to the outlet port via the supply port.

Preferably, in the aforementioned liquid ejecting head, the reserve chamber includes: a first flow channel which causes the liquid to flow into the pressure chamber through the inlet port; and a second flow channel which collects the liquid flowed out through the outlet port, in which the second flow channel communicates with the first flow channel.

According to the aforementioned aspect, the liquid within the reserve chamber circulates. This allows heat generated in the switch circuit to be efficiently dissipated through the liquid within the reserve chamber.

Preferably, in the aforementioned liquid ejecting head, at least a part of the circuit substrate is provided between the reserve chamber and the pressure chamber.

According to the aforementioned aspect, the circuit substrate on which the switch circuit is provided is provided between the reserve chamber and the pressure chamber. This allows heat generated in the switch circuit to be efficiently dissipated through the liquid within the reserve chamber and the pressure chamber.

Preferably, the aforementioned liquid ejecting head includes a plurality of the nozzles, in which the plurality of nozzles include a first nozzle and a second nozzle located on the opposite side of the second flow channel from the first nozzle in a plan view.

According to the aforementioned aspect, heat generated in the switch circuit is efficiently dissipated through the liquid within the first flow channel and the second flow channel.

Preferably, the aforementioned liquid ejecting head includes a plurality of the nozzles, in which the plurality of nozzles are provided at a density of 300 nozzles or more per inch.

According to the aforementioned aspect, at image formation, for example, it is possible to form an image of a high resolution with the liquid ejected from the liquid ejecting head.

Preferably, in the aforementioned liquid ejecting head, the piezoelectric element is driven so that the liquid filling the pressure chamber is ejected through the nozzle 30000 times or more per second.

According to the aforementioned aspect, at image formation, for example, it is possible to form an image at high speed with the liquid ejected from the liquid ejecting head.

Preferably, in the aforementioned liquid ejecting head, the cross-sectional area of the inlet port is larger than the cross-sectional area of the outlet port.

According to the aforementioned aspect, the liquid is more easily ejected from the nozzle than in the case where the cross-sectional area of the outlet port is larger than the cross-sectional area of the inlet port.

Preferably, in the aforementioned liquid ejecting head, at least a part of the switch circuit is located between the piezoelectric element and the reserve chamber.

According to the aforementioned aspect, the distance between the switch circuit and the piezoelectric element can be made shorter than that in the case where the reserve chamber is located between the switch circuit and the piezoelectric element, for example. Accordingly, the switch circuit and the piezoelectric element can be electrically connected with a shorter wire, thus reducing the amount of heat generated when the wire transmits the drive signal.

Preferably, in the aforementioned liquid ejecting head, at least a part of the reserve chamber overlaps both of at least a part of the piezoelectric element and at least a part of the switch circuit in a plan view.

According to the aforementioned aspect, the reserve chamber is formed so as to include space above the piezoelectric element and the switch circuit. It is therefore possible to secure the capacity of the reserve chamber more easily than in the case where the reserve chamber is formed so as not to include the space above the piezoelectric element and the switch circuit.

Preferably, the aforementioned liquid ejecting head includes a plurality of the piezoelectric elements; and a wire member which is provided at an end of the circuit substrate in a direction where the plurality of piezoelectric elements are arranged and is electrically connected to the switch circuit.

According to the aforementioned aspect, the wire member and the circuit substrate are connected at an end of the circuit substrate. The space to place the wire member is therefore smaller than that in the case where the wire member and the circuit substrate are connected at the center of the circuit substrate, thus enabling miniaturization of the liquid ejecting head.

Preferably, in the aforementioned liquid ejecting head, the switch circuit generates heat when switching between supply and shut-off of the drive signal to the piezoelectric element, and the circuit substrate is provided so that heat generated in the switch circuit propagates to the liquid within the pressure chamber.

According to the aforementioned aspect, heat generated in the switch circuit is efficiently dissipated through the liquid within the pressure chamber.

Preferably, in the aforementioned liquid ejecting head, when the piezoelectric element is driven, the temperature of the switch circuit is higher than the temperature of the liquid within the pressure chamber, and heat in the switch circuit propagates to the liquid within the pressure chamber to reduce an increase in the temperature of the switch circuit.

According to the aforementioned aspect, heat generated in the switch circuit is efficiently dissipated through the liquid within the pressure chamber.

A liquid ejecting head according to an aspect of the invention includes: a first pressure chamber filled with liquid; a second pressure chamber filled with the liquid; a reserve chamber which reserves the liquid to be supplied to the first pressure chamber and the second pressure chamber, a first connecting flow channel which has one end communicating with the first pressure chamber and the other end communicating with the reserve chamber; a second connecting flow channel which has one end communicating with the second pressure chamber and the other end communicating with the reserve chamber; a link flow channel which has one end communicating with the first pressure chamber and the other end communicating with the second pressure chamber; a nozzle which ejects the liquid filling the first pressure chamber; a vibration plate constituting the wall surface of the first pressure chamber; a piezoelectric element driven with a drive signal; a circuit substrate provided on the vibration plate; and a switch circuit which is provided on the circuit substrate and switches between supply and shut-off of the drive signal to the piezoelectric element, in which the piezoelectric element is provided in a sealed space defined by a plurality of members including the circuit substrate.

According to the aforementioned aspect, the circuit substrate on which the switch circuit is provided is located on the vibration plate. This allows heat generated in the switch circuit to be efficiently dissipated through the liquid flowing from the first connecting flow channel to the second connecting flow channel via the first pressure chamber, the link flow channel, and the second pressure chamber, for example. According to the aspect, therefore, the likelihood that the switch circuit becomes hot is lower than that in the case where the liquid ejecting head does not include the link flow channel.

A liquid ejecting apparatus according to a preferred aspect of the invention includes the liquid ejecting head according to each aspect illustratively shown above. A preferred example of the liquid ejecting apparatus is a printing apparatus that ejects ink. However, the application of the liquid ejecting apparatus according to the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
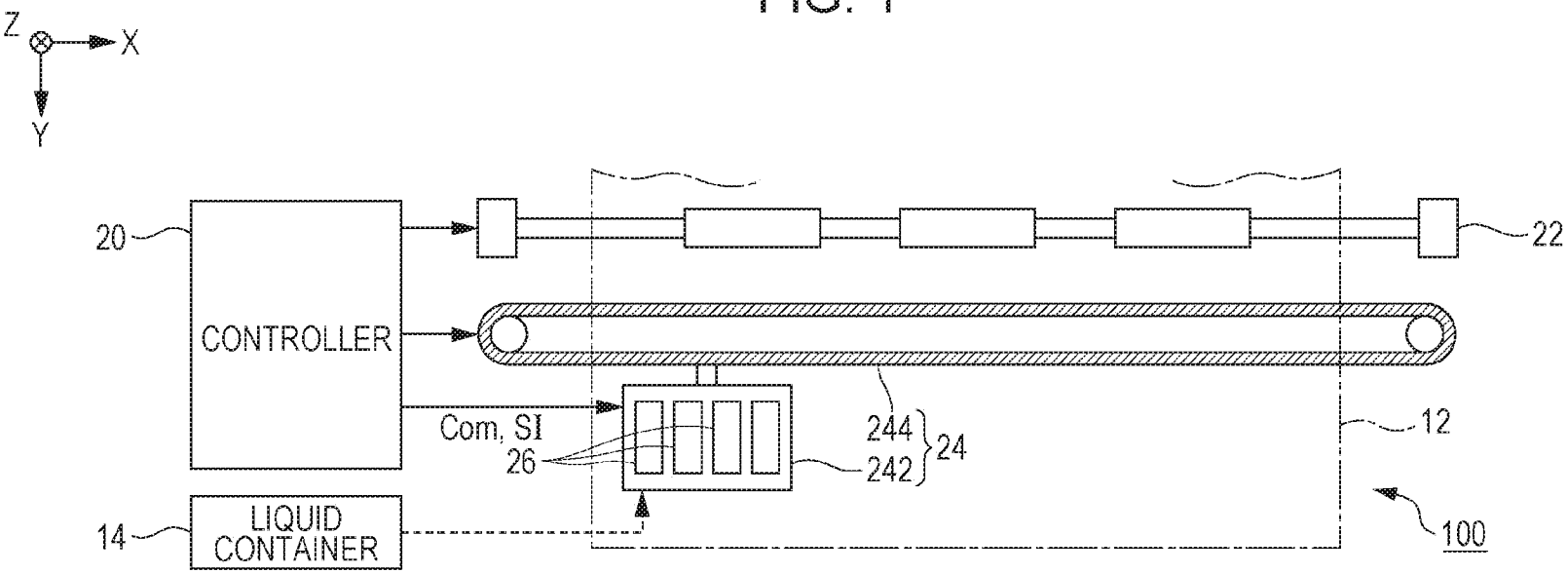
FIG. 1 is a configuration diagram of a liquid ejecting apparatus according to a first embodiment of the invention.

Hereinafter, a description is given of embodiments for carrying out the invention with reference to the drawings. In the drawings, the dimensions and scale of each component may be appropriately made different from actual ones. The following embodiments are preferable specific examples of the invention and are given various technically preferred limitations. The scope of the invention is not limited by the embodiments unless it is particularly noted in the following description that the invention is limited.

First Embodiment

Hereinafter, a description is given of a liquid ejecting apparatus 100 according to a first embodiment with reference to FIGS. 1 to 5.

1. Summary of Liquid Ejecting Apparatus

FIG. 1 is a configuration diagram illustratively showing the liquid ejecting apparatus 100 according to the first embodiment. The liquid ejecting apparatus 100 according to the first embodiment is an ink jet printing apparatus that ejects ink, as an example of liquid, to a medium 12. The medium 12 is typically printing paper but can be any print object, such as resin film or fabric.

As illustratively shown in FIG. 1, the liquid ejecting apparatus 100 further includes a liquid container 14, which stores ink. The liquid container 14 can be a cartridge detachable from the liquid ejecting apparatus 100, a pouch-type ink pack made of flexible film, or an ink-refillable tank, for example. The liquid container 14 stores plural types of ink of different colors.

As illustratively shown in FIG. 1, the liquid ejecting apparatus 100 includes a controller 20, a transporting mechanism 22, a moving mechanism 24, and a plurality of liquid ejecting heads 26.

The controller 20 includes: a processing circuit such as a central processing unit (CPU) or a field programmable gate array (FPGA), for example; and a memory circuit such as a semiconductor memory. The controller 20 controls each component of the liquid ejecting apparatus 100. In the first embodiment, the transporting mechanism 22 transports the medium 12 in a +Y direction under the control by the controller 20. In the following description, the +Y direction and a −Y direction, which is the opposite direction to the +Y direction, are collectively referred to as a Y-axis direction in some cases.

The moving mechanism 24 reciprocates the plurality of liquid ejecting heads 26 in a +X direction and a −X direction, which is the opposite direction to the +X direction, under the control by the controller 20. Herein, +X direction refers to a direction which intersects (typically orthogonally) with the +Y direction, in which the medium 12 is transported. In the following description, the +X and −X directions are sometimes collectively referred to as an X-axis direction. The moving mechanism 24 includes: a substantially box-shaped transporter (a carriage) 242, which accommodates the plurality of liquid ejecting heads 26; and an endless belt 244, to which the transporter 242 is fixed. The liquid container 14 can be mounted on the transporter 242 together with the liquid ejecting heads 26.

Each of the plurality of liquid ejecting heads 26 is supplied with ink from the liquid container 14. Each of the plurality of liquid ejecting heads 26 is also supplied with a drive signal Com and a control signal SI from the controller 20. The drive signal Com is a signal to drive the liquid ejecting head 26, and the control signal SI is a signal to control the liquid ejecting head 26. Each of the plurality of liquid ejecting heads 26 is driven through the drive signal Com under the control by the control signal SI to eject ink through some or all of 2M nozzles (ejecting ports) in a +Z direction (M is a natural umber not less than 1).

Herein, the +Z direction is a direction which intersects (typically orthogonally) with the +X and +Y directions. In the following directions, the +Z direction and a −Z direction, which is the opposite direction to the +Z direction, are collectively referred to as a Z-axis direction. Each of the liquid ejecting heads 26 ejects ink through some or all of the 2M nozzles in conjunction with transportation of the medium 12 by the transporting mechanism 22 and reciprocation of the transporter 242 so that the ejected ink adheres to the surface of the medium 12, thereby forming a desired image on the surface of the medium 12.

2. Structure of Liquid Ejecting Head

Figure 2:
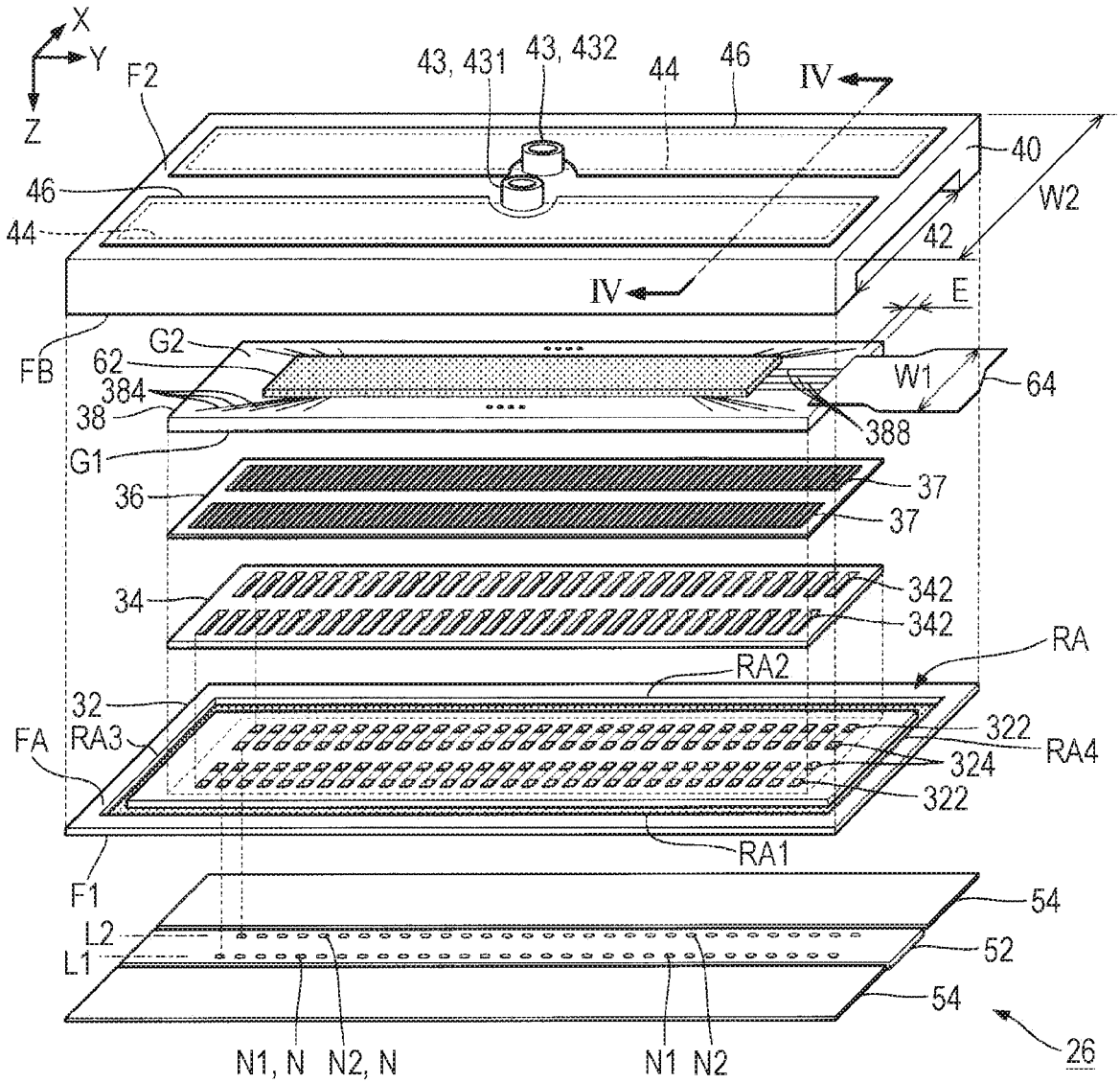
FIG. 2 is an exploded perspective view of a liquid ejecting head.
Figure 3:
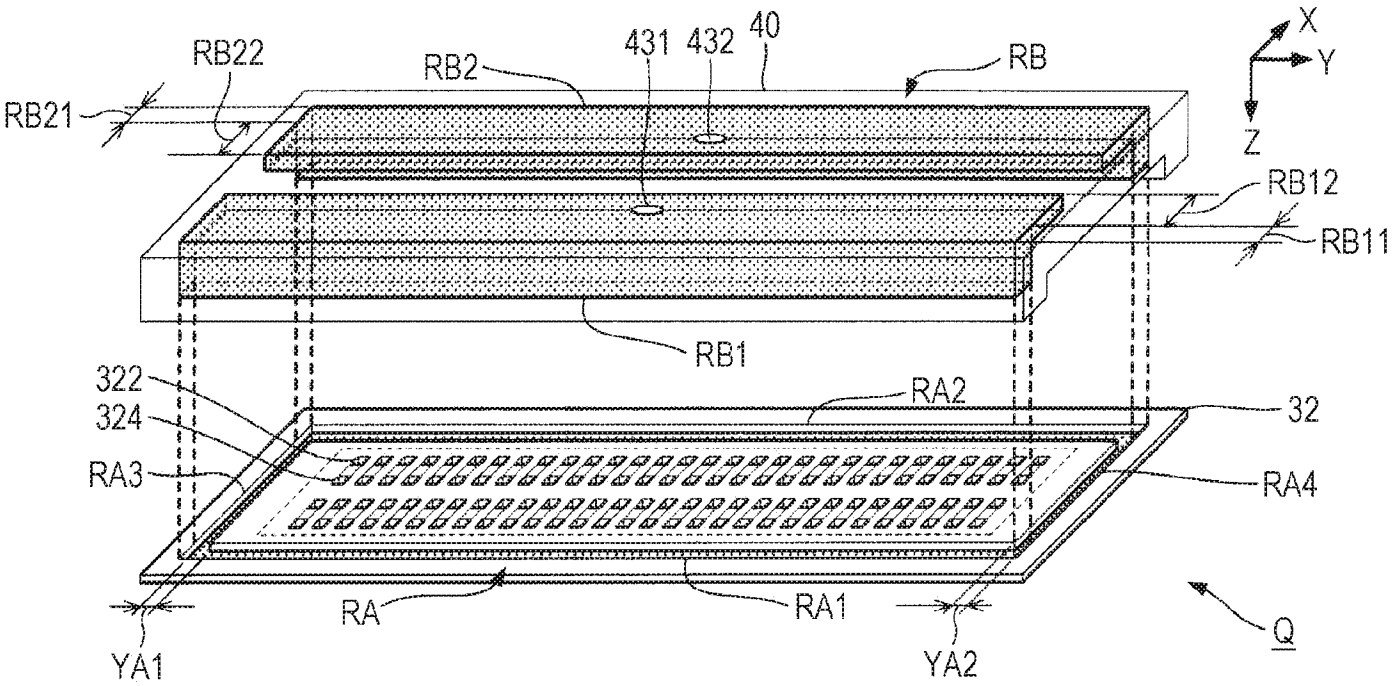
FIG. 3 is an exploded perspective view of a reservoir.
Figure 4:
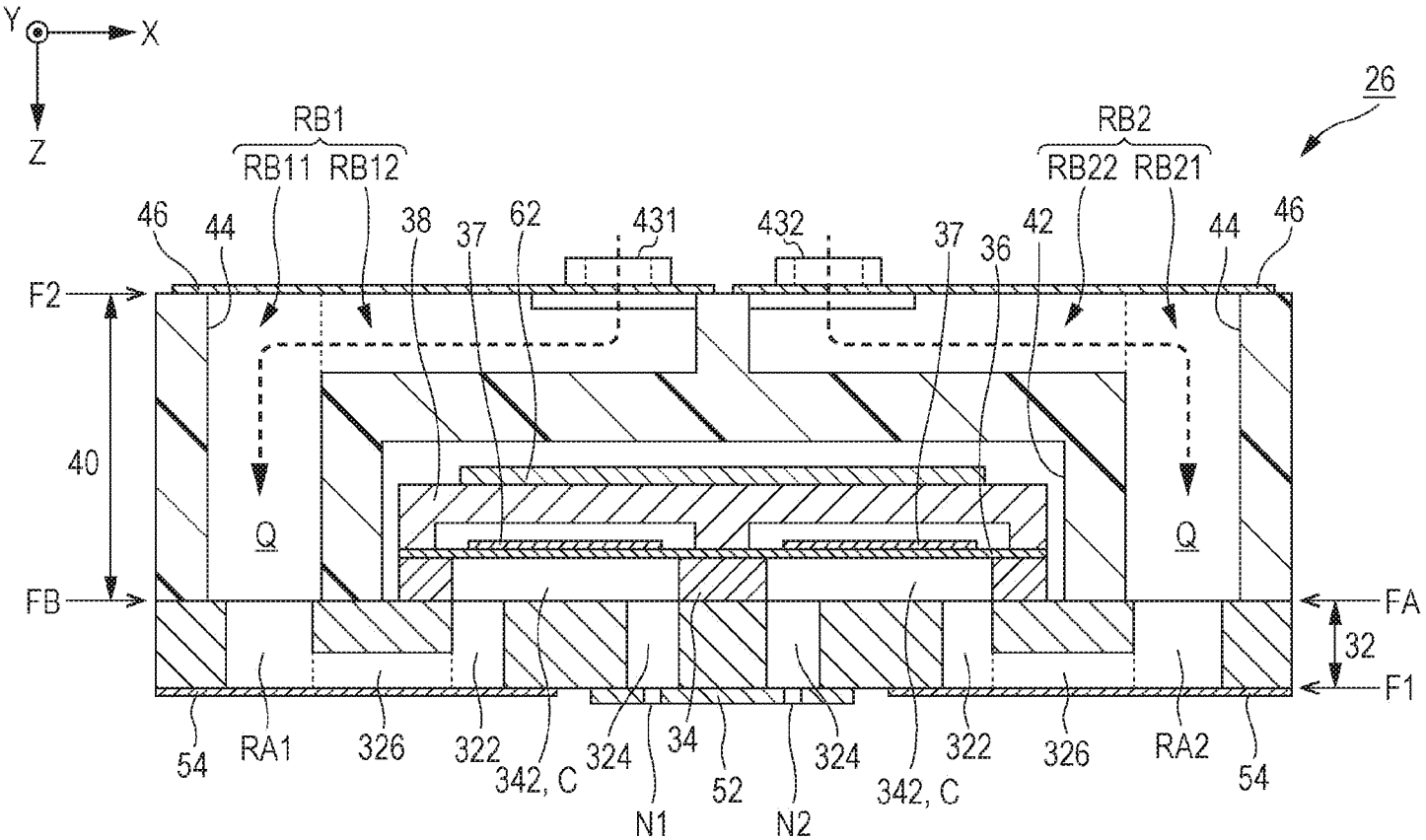
FIG. 4 is a cross-sectional view of the liquid ejecting head.

FIG. 2 is an exploded perspective view of each liquid ejecting head 26. FIG. 3 is an exploded perspective view for explaining a reservoir Q (an example of a reserve chamber), provided for each liquid ejecting head 26. FIG. 4 is a cross-sectional view along a line IV-IV in FIG. 2.

As illustratively shown in FIG. 2, the liquid ejecting head 26 is provided with 2M nozzles N, which are arranged in the Y-axis direction. In the first embodiment, the 2M nozzles N are separately arranged in two lines L1 and L2. In the following description, each of the M nozzles N included in the line L1 is sometimes referred to as a nozzle N1 (an example of a first nozzle), and each of the M nozzles N included in the line L2 is sometimes referred to as a nozzle N2 (an example of a second nozzle). In the first embodiment, it is assumed as an example that the m-th nozzle N1, which is located at the m-th position from an end on the −Y side among the M nozzles N1 (included in the line L1), and the m-th nozzle N2, which is located at the m-th position from an end on the −Y side among the M nozzles N2 (included in the line L2), are positioned at substantially the same location in the Y-axis direction (a is a natural number satisfying 1<=m<=M). Herein, the concept "substantially the same" includes cases where the positions of the m-th nozzle N1 and m-th nozzle N2 are completely the same and also includes cases where the positions of the m-th nozzle N1 and m-th nozzle N2 are considered to be the same by taking positional errors into account.

The 2M nozzles N may be arranged in a so-called staggered manner so that the m-th nozzle N1, which is located at the m-th position from the end on the −Y side among the M nozzles N1 (included in the line L1), and the m-th nozzle N2, which is located at the m-th position from the end on the −Y side among the M nozzles N2 (included in the line L2), are positioned at different locations in the Y-axis direction.

As illustratively shown in FIGS. 2 to 4, the liquid ejecting head 26 includes a flow channel substrate 32. The flow channel substrate 32 is a plate-shaped member including a face F1 and a face FA. The face F1 is the surface on the +Z side (the surface on the medium 12 side, seen from the liquid ejecting head 26). The face FA is the surface opposite to the face F1 (on the −Z side). On the face FA, a pressure chamber substrate 34, a vibration unit 36, a plurality of piezoelectric elements 37, a protection member 38, and a housing 40 are provided. On the face F1, a nozzle plate 52 and vibration absorbers 54 are provided. Each component of the liquid ejecting head 26 is substantially a plate-shaped member elongated in the Y-axis direction in a similar manner to the flow channel substrate 32. The components of the liquid ejecting head 26 are bonded to each other using an adhesive, for example. The Z-axis direction can be also considered as a direction in which the flow channel substrate 32, pressure chamber substrate 34, protection member 38, and nozzle plate 52 are stacked.

The nozzle plate 52 is a plate-shaped member in which the 2M nozzles N are formed. The nozzle plate 52 is provided on the face F1 of the flow channel substrate 32 using an adhesive, for example.

Each nozzle N is a through-hole provided in the nozzle plate 52. The nozzle plate 52 is produced by processing a silicon (Si) single crystal substrate using a semiconductor manufacturing technique, including etching, for example. Any publicly-known materials and processes can be employed to manufacture the nozzle plate 52.

The first embodiment assumes that the M nozzles N corresponding to each of the lines L1 and L2 are provided at a density of 300 nozzles or more per inch in the nozzle plate 52. The M nozzles N corresponding to each of the lines L1 and L2 are provided at a density of at least 100 nozzles per inch in the nozzle plate 52 and are preferably provided at a density of 200 nozzles or more per inch.

The flow channel substrate 32 is a plate-shaped member that forms a flow channel for ink. As illustratively shown in FIGS. 2 to 4, a flow channel RA is formed in the flow channel substrate 32. The flow channel RA includes: a flow channel RA1, which is provided corresponding to the line L1; a flow channel RA2, which is provided corresponding to the line L2; a flow channel RA3, which connects the flow channels RA1 and RA2; and a flow channel RA4, which connects the flow channels RA1 and RA2. The flow channel RA1 is an opening elongated in the Y-axis direction. The flow channel RA2 is an opening which is located on the +X side of the flow channel RA1 and is elongated in the Y-axis direction. The flow channel RA3 is an opening which is formed so as to connect an end of the flow channel RA1 on the −Y side, which is located in a region YA1 (see FIG. 3), to an end of the flow channel RA2 on the −Y side, which is in the region YA1. The flow channel RA4 is an opening which is formed so as to connect an end of the flow channel RA1 on the +Y side, which is located in a region YA2 (see FIG. 3), to an end of the flow channel RA2 on the +Y side, which is in the region YA2.

In the flow channel substrate 32, 2M flow channels 322 and 2M flow channels 324 (an example of a communicating flow channel) are formed corresponding one-to-one to the 2M nozzles N. As illustratively shown in FIG. 4, the flow channels 322 and 324 are openings formed so as to penetrate the flow channel substrate 32. The flow channels 324 communicate with the nozzles N corresponding to the same flow channels 324.

As illustratively shown in FIG. 4, in the face F1 of the flow channel substrate 32, two flow channels 326 are formed. One of the two flow channels 326 is a flow channel connecting the flow channel RA1 to the M flow channels 322, which correspond one-to-one to the M nozzles N1 included in the line L1. The other one of the two flow channels 326 is a flow channel connecting the flow channel RA2 and the N flow channels 322, which correspond one-to-one to the M nozzles N2 included in the line L2.

As illustratively shown in FIGS. 2 and 4, the pressure chamber substrate 34 is a plate-shaped member in which the 2M openings 342 are formed corresponding one-to-one to the 2M nozzles N. The pressure chamber substrate 34 is provided on the face FA of the flow channel substrate 32 using an adhesive, for example.

The flow channel substrate 32 and pressure chamber substrate 34 are produced by processing a silicon (Si) single-crystal substrate using a semiconductor manufacturing technique, for example. Any publicly-known materials and processes can be employed to manufacture the flow channel substrate 32 and pressure chamber substrate 34.

As illustratively shown in FIGS. 2 and 4, the vibration unit 36 is provided on the surface of the pressure chamber substrate 34 which is opposite to the flow channel substrate 32. The vibration unit 36 is a plate-shaped member able to elastically vibrate. The vibration unit 36 can be integrally formed with the pressure chamber substrate 34 by selectively removing the plate-shaped member constituting the vibration unit 36 in the regions corresponding to the openings 342, partially in the thickness direction.

As understood from FIG. 4, the face FA of the flow channel substrate 32 and the vibration unit 36 face each other with an interval therebetween in each opening 342. The space located between the face FA of the flow channel substrate 32 and vibration unit 36 in each opening 342 functions as a pressure chamber C that applies pressure to ink filling the space. In the first embodiment, the vibration unit 36 is an example of a vibration plate constituting the wall surface of the pressure chamber C. The pressure chamber C is a space long in the X-axis direction and short in the Y-axis direction, for example. The liquid ejecting head 26 includes 2M pressure chambers C corresponding one-to-one to the 2M nozzles N. As illustratively shown in FIG. 4, the pressure chamber C corresponding to the nozzle N1 communicates with the flow channel RA1 through the flow channels 322 and 326 and also communicates with the nozzle N1 through the flow channel 324. The pressure chamber C corresponding to the nozzle N2 communicates with the flow channel RA2 through the flow channels 322 and 326 and also communicates with the nozzle N2 through the flow channel 324.

As illustratively shown in FIGS. 2 and 4, the 2M piezoelectric elements 37 are provided on the surface of the vibration unit 36 opposite to the pressure chambers C so as to correspond one-to-one to the 2M pressure chambers C. Each of the piezoelectric elements 37 is a passive device which deforms upon supply of the drive signal Com.

Figure 5:
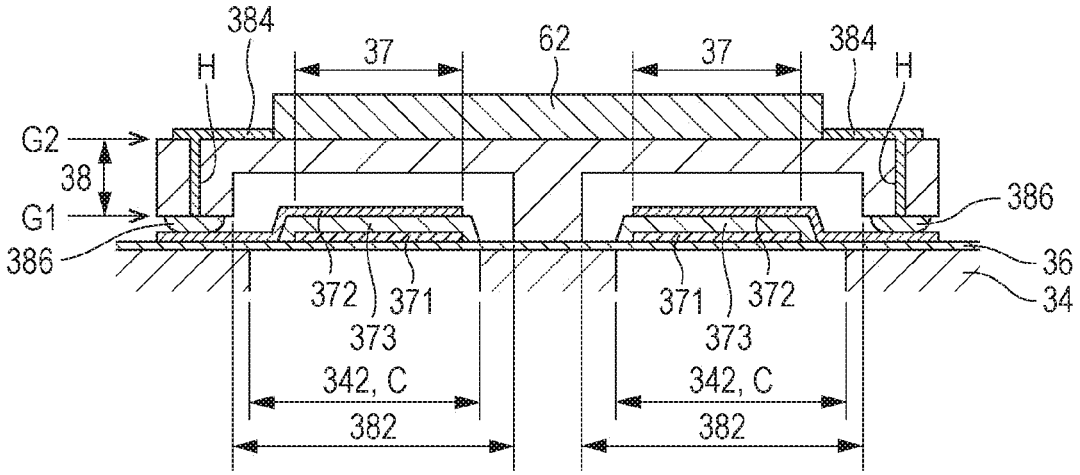
FIG. 5 is an enlarged cross-sectional view around piezoelectric elements.

FIG. 5 is an enlarged cross-sectional view around the piezoelectric elements 37. As illustratively shown in FIG. 5, each of the piezoelectric elements 37 is a laminate including electrodes 371 and 372 and a piezoelectric layer 373. The electrodes 371 and 372 face each other, and the piezoelectric layer 373 is provided between the electrodes 371 and 372. Each piezoelectric element 37 is a part in which the electrodes 371 and 372 and piezoelectric layer 373 overlap each other in a plan view seen from the −Z side, for example.

As described above, the piezoelectric elements 37 deform (are driven) upon supply of the drive signal Com. The vibration unit 36 vibrates with the deformation of the piezoelectric elements 37. When the vibration unit 36 vibrates, the pressure within the pressure chambers C fluctuates. When the pressure within each pressure chamber C fluctuates, the ink filling the pressure chamber C is ejected through the corresponding flow channel 324 and nozzle N. The first embodiment assumes that the drive signal Com can drive the piezoelectric elements 37 so that ink is ejected from each nozzle N at least 30000 times per second.

Each pressure chamber C, the flow channel 322, nozzle N, and piezoelectric element 37 corresponding to the pressure chamber C, and the vibration unit 36 function as an ejecting section that ejects ink filling the pressure chamber C.

The protection member 38 illustratively shown in FIGS. 2 and 4 is a plate-shaped member to protect the 2M piezoelectric elements 37, which are formed on the vibration unit 36. The protection member 38 is provided on the surface of the vibration unit 36 or the surface of the pressure chamber substrate 34. In the first embodiment, the protection member 38 is provided over the ejecting section. The protection member 38 is produced by processing a silicon (Si) single crystal plate using a semiconductor manufacturing technique, for example. Any publicly-known materials and processes can be employed to manufacture the protection member 38.

As illustratively shown in FIG. 5, on a face G1, which is the surface of the protection member 38 on the +Z side, two accommodation spaces 382 are formed. One of the two accommodation spaces 382 is a space for accommodating the M piezoelectric elements 37 corresponding to the M nozzles N1 while the other accommodation space 382 is a space for accommodating the M piezoelectric elements 37 corresponding to the M nozzles N2. When the protection member 38 is located over the ejecting sections, the accommodation spaces 382 function as a sealed space which is sealed so as to prevent the piezoelectric elements 37 from changing in properties by the influence of oxygen, water, or the like. The accommodation spaces 382 (or sealed spaces) have enough width (height) in the Z-axis direction to separate the piezoelectric elements 37 from the protection members 38 even when the piezoelectric elements 37 are displaced. Accordingly, even when the piezoelectric elements 37 are displaced, noise due to displacement of the piezoelectric elements 37 is prevented from propagating to the outside of the accommodation spaces 382 (or sealed spaces).

On the face G2, which is the surface of the protection member 38 on the −Z side, an integrated circuit 62 (an example of a switch circuit) is provided. The protection member 38 functions as a circuit substrate on which the integrated circuit 62 is mounted.

The integrated circuit 62 switches between supply and shut-off of the drive signal Com to each piezoelectric element 37 under the control by the control signal SI. In the first embodiment, the drive signal Con is generated by the controller 20. However, the invention is not limited to this mode. The drive signal Com may be generated in the integrated circuit 62.

As illustratively shown in FIGS. 2, 4, and 5, the integrated circuit 62 according to the first embodiment overlaps at least some of the 2M piezoelectric elements 37, which are provided in the liquid ejecting head 26, in a plan view. Moreover, the integrated circuit 62 according to the first embodiment overlaps both some of the piezoelectric elements 37 corresponding to the nozzles N1 and some of the piezoelectric elements 37 corresponding to the nozzles N2 in a plan view.

As illustratively shown in FIG. 2, on the face G2 of the protection member 38, 2M wires 384 are formed so as to correspond one-to-one to the 2M piezoelectric elements 37, for example. The wires 384 are electrically connected to the integrated circuit 62. As illustratively shown in FIG. 5, the wires 384 are electrically connected to respective connection terminals 386, which are provided on the face G1, through respective conducting holes (contact holes) H, which penetrate the protection member 38. The contact terminals 386 are electrically connected to the electrodes 372 of the respective piezoelectric elements 37. The drive signal Con outputted from the integrated circuit 62 is supplied to the piezoelectric elements 37 through the wires 384, conducting holes H, and connection terminals 386.

As illustratively shown in FIG. 2, on the face G2 of the protection member 38, a plurality of wires 388 are formed. The plurality of wires 388 are electrically connected to the integrated circuit 62. The plurality of wires 388 extend to a region E, which is an end of the face G2 of the protection member 38 on the +Y side. The region E of the face G2 is joined to a wire member 64. The wire member 64 is a component including plural wires electrically connecting the controller 20 to the integrated circuit 62. The wire member 64 may be a flexible wiring substrate, such as a flexible printed circuit (FPC) or a flexible flat cable (FFC), for example.

The housing 40 illustratively shown in FIGS. 2 to 4 is a casing which reserves ink to be supplied to the 2M pressure chambers C (then supplied to the 2M nozzles N). A face FB, which is the surface of the housing 40 on the +Z side, is fixed to the face FA of the flow channel substrate 32 with an adhesive, for example. As illustratively shown in FIGS. 2 and 4, a recess 42 extending in the Y-axis direction is formed in the face FB of the housing 40. The protection member 38 and integrated circuit 62 are accommodated within the recess 42. The wire member 64, which is joined to the region E of the protection member 38, is extended in the Y-axis direction through the recess 42. As understood from FIG. 2, width W1 (the maximum dimension in the X-axis direction) of the wire member 64 is less than width W2 of the housing 40 (W1<W2).

In the first embodiment, the housing 40 is made of a material separate from the flow channel substrate 32 and pressure chamber substrate 34. The housing 40 is formed by injection molding for a resin material, for example. Any publicly-known materials and processes can be employed to manufacture the housing 40. The material of the housing 40 can be preferably synthetic fiber such as poly(p-phenylene benzobisoxazole) (Zylon (registered trademark)) or a resin material such as a liquid crystal polymer, for example.

As illustratively shown in FIGS. 3 and 4, a flow channel RB is formed in the housing 40. The flow channel RB includes: a flow channel RB1, which communicates with the flow channel RA1; and a flow channel RB2, which communicates with the flow channel RA2. The flow channels RA and RB function as the reservoir Q, which reserves ink to be supplied to the 2M pressure chambers C.

In a face F2, which is the surface of the housing 40 on the −Z side, two feed ports 43 are provided, through which the ink supplied from the liquid container 14 is introduced to the reservoir Q. One of the two feed ports 43 (hereinafter, sometimes referred to as an feed port 431) communicates with the flow channel RB1 while the other feed port 43 (hereinafter, sometimes referred to as a feed port 432) communicates with the flow channel RB2.

As illustratively shown in FIGS. 3 and 4, the flow channel RB1 is a space elongated in the Y-axis direction and includes flow channels RB11 and RB12. The flow channel RB11 communicates with the flow channel RA1, and the flow channel RB12 communicates with the feed port 431. The flow channel RB2 is a space elongated in the Y-axis direction and includes flow channels RB21 and RB22. The flow channel RB21 communicates with the flow channel RA2; and the flow channel RB22 communicates with the feed port 432.

As understood from FIG. 4, the protection member 38 and integrated circuit 62 are located between the flow channels RB11 and RB21. Specifically, the protection member 38 and integrated circuit 62 are provided in a space between the flow channels RB11 and RB21. In other words, the region where the protection member 38 and integrated circuit 62 are provided is contained in the region where the flow channel RB11 or RB21 is provided in a cross-sectional view seen in the X-axis direction (the +X or −X direction).

As understood in FIG. 4, in a plan view seen from the +Z or −Z direction, at least a part of the protection member 38 and at least a part of the integrated circuit 62 are located between the flow channel RB12 or RB22 and pressure chambers C. In other words, at least a part of the protection member 38 and at least a part of the integrated circuit 62 are provided between the reservoir Q and pressure chambers C.

As understood in FIG. 4, in a plan view seen from the +Z or −Z direction, at least a part of the protection member 38 and at least a part of the integrated circuit 62 are located between the piezoelectric elements 37 and the flow channel RB12 or RB22. Moreover, at least a part of the protection member 38 and at least a part of the integrated circuit 62 are provided between the reservoir Q and piezoelectric elements 37. In other words, at least a part of the reservoir Q overlaps at least a part of the protection member 38, at least a part of the integrated circuit 62, and at least some of the piezoelectric elements 37.

As indicated by dashed arrows in FIG. 4, ink supplied from the liquid container 14 to the feed port 431 flows through the flow channels RB12 and RB11 into the flow channel RA1. A part of the ink having flown into the flow channel RA1 is supplied through the flow channels 326 and 322 to the pressure chamber C corresponding to the nozzle N1. The ink having filled the pressure chamber C corresponding to the nozzle N1 flows through the corresponding flow channel 324 in the +Z direction to be ejected through the nozzle N1.

The ink supplied from the liquid container 14 to the feed port 432 flows into the flow channel RA2 through the flow channels RB22 and RB21. A part of the ink having flown into the flow channel RA2 is supplied to the pressure chamber C corresponding to the nozzle N2 through the corresponding flow channels 326 and 322. The ink having filled the pressure chamber C corresponding to the nozzle N2 flows through the corresponding flow channels 324 in the +Z direction to be ejected through the nozzle N2.

As illustratively shown in FIG. 3, the flow channel RA is an annular flow channel. More specifically, as described above, the end of the flow channel RA1 on the −Y side and the end of the flow channel RA2 on the −Y side are connected by the flow channel RA3, and the end of the flow channel RA1 on the +Y side and the end of the flow channel RA2 on the +Y side are connected by the flow channel RA4. This forms a circulation route of: "the flow channel RA1→the flow channel RA3→the flow channel RA2→the flow channel RA4→the flow channel RA1", for example. Accordingly, ink supplied to the flow channel RA1 or RA2 through the feed ports 43 is able to circulate within the flow channel RA.

As illustratively shown in FIGS. 2 and 4, in the face F2 of the housing 40, in addition to the aforementioned two feed ports 43, and openings 44 corresponding to the aforementioned reservoir Q are formed. On the face F2 of the housing 40, two vibration absorbers 46 are provided so as to cover the openings 44. Each vibration absorber 46 is a flexible film (a compliance substrate) that absorbs fluctuations in the pressure of the ink within the reservoir Q and constitutes the wall surface of the reservoir Q.

As illustratively shown in FIG. 2, on the face F1 of the flow channel substrate 32, the vibration absorbers 54 are provided so as to cover the flow channels RA1 and RA2, two flow channels 326, and a plurality of flow channels 322. Each vibration absorber 54 is a flexible film (a compliance substrate) that absorbs changes in pressure of ink within the reservoir Q and constitutes the wall surface of the reservoir Q.

3. Effect of First Embodiment

Generally, the drive signal Com for driving the piezoelectric elements 37 has a large amplitude. When supplying the drive signal Con to the piezoelectric elements 37, the integrated circuit 62 therefore generates heat. When the piezoelectric elements 37 are driven at a high frequency (a large number of times per unit time) particularly like in the first embodiment, the integrated circuit 62 generates a large amount of heat. Moreover, when the ejecting sections, including the nozzles N and piezoelectric elements 37, are provided with a high density in the liquid ejecting head 26, like in the first embodiment, the integrated circuit 62 generates a large amount of heat per unit area. When the integrated circuit 62 is reduced in size for miniaturization of the liquid ejecting head 26, the amount of heat per unit area generated by the integrated circuit 62 is increased. Moreover, when the protection member 38, on which the integrated circuit 62 is provided, is mounted over the ejecting sections like in the first embodiment, the integrated circuit 62 and protection member 38 are not exposed to the air outside of the liquid ejecting head 26 (alternatively the integrated circuit 62 and protection member 38 are exposed to the air outside of the liquid ejecting head 26 through a small area). The efficiency of heat dissipation from the integrated circuit 62 is therefore reduced, so that the integrated circuit 62 becomes hot sometimes.

On the other hand, in the first embodiment, the integrated circuit 62 and protection member 38 are provided between the flow channels RB11 and RB21. In the first embodiment, therefore, heat generated from the integrated circuit 62 is dissipated through the ink within the reservoir Q even when the integrated circuit 62 and protection member 38 are not directly exposed to the air outside of the liquid ejecting head 26.

In the first embodiment, moreover, the flow channel RA forms a circulation route of: "the flow channel RA1→the flow channel RA3→the flow channel RA2→the flow channel RA4→the flow channel RA1".

In the first embodiment, heat generated from the integrated circuit 62 can be efficiently dissipated through the ink within the reservoir Q, compared with the configuration of the reservoir Q not including a circulation route of ink.

In the first embodiment, the integrated circuit 62 and protection member 38 are provided between the reservoir Q and pressure chambers C. Accordingly, beat generated from the integrated circuit 62 can be efficiently dissipated through the ink within the reservoir Q and ink within the pressure chambers C in the first embodiment.

In the first embodiment, the reservoir Q includes the flow channels RB12 and RB22, where the reservoir Q overlaps at least a part of the protection member 38 and at least a part of the integrated circuit 62 in a plan view. In the first embodiment, it is therefore possible to easily implement both miniaturization of the liquid ejecting head 26 and an increase in capacity of the reservoir Q compared with the configuration where the reservoir Q does not overlap the protection member 38 and integrated circuit 62 in a plan view.

In the first embodiment, the piezoelectric elements 37 are accommodated in the accommodation spaces 382, which are formed on the face G1 of the protection member 38, and the integrated circuit 62 is provided on the face G2 of the protection member 38. In other words, in the first embodiment, the piezoelectric elements 37 are accommodated in the rear surface of the substrate where the integrated circuit 62 is formed. Accordingly, the integrated circuit 62 and piezoelectric elements 37 can be electrically connected with shorter wires in the first embodiment than in the case where the piezoelectric elements 37 are provided in a place different from the rear surface of the substrate where the integrated circuit 62 is formed. This can prevent the waveform of the drive signal Com from being disturbed due to the resistance and capacitance components of the wires in the first embodiment. Moreover, reduction in the resistance of the wires can reduce the amount of heat generated by the wires.

In the first embodiment, the wire member 64 is provided in the region E at an end of the protection member 38. Accordingly, the space to mount the wire member 64 can be reduced compared with a case where the wire member 64 extends in the region from the end of the protection member 38 to the center thereof. Accordingly, in the first embodiment, it is possible to implement both miniaturization of the liquid ejecting head 26 and an increase in the capacity of the reservoir Q.

In the first embodiment, the vibration absorbers 54 and 46 absorb fluctuations in the pressure within the reservoir Q. This can reduce the likelihood that ink ejecting characteristics (the amount of ink ejected, ink ejecting speed, and ink ejecting direction, for example) would change due to propagation of the fluctuations in the pressure within the reservoir Q to the pressure chambers C.

Second Embodiment

Hereinafter, a description is given of a liquid ejecting apparatus according to a second embodiment with reference to FIGS. 6 to 8. In each mode illustratively shown in the following description, the elements providing the same operations or functions as those of the first embodiment are given the same reference numerals as those used in the description of the first embodiment. The detailed description thereof are properly omitted.

Figure 6:
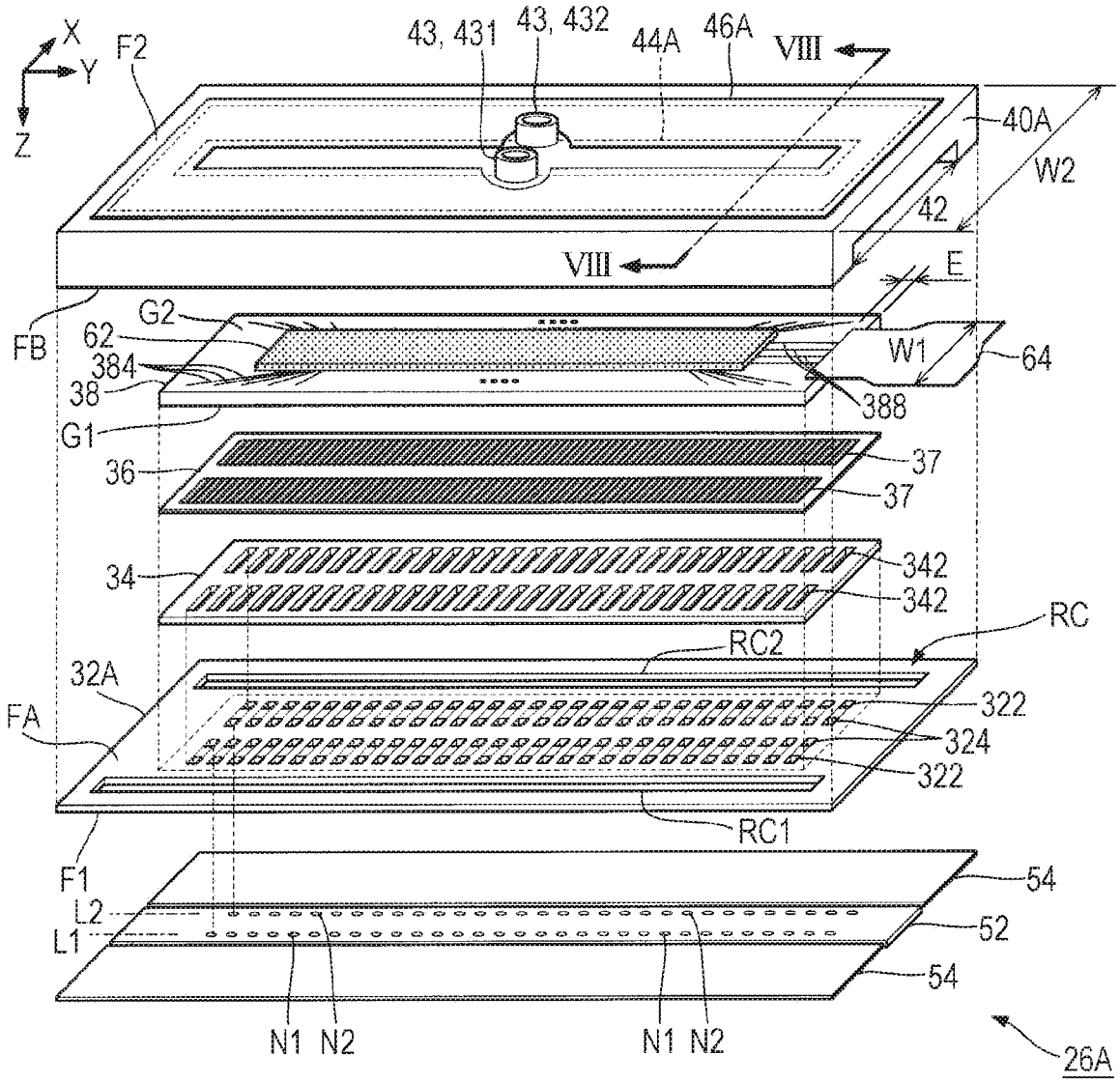
FIG. 6 is an exploded perspective view of a liquid ejecting head according to a second embodiment.

FIG. 6 is an exploded perspective view of a liquid ejecting head 26A which is provided for the liquid ejecting apparatus according to the second embodiment. FIG. 7 is an exploded perspective view for explaining a reservoir QA (another example of the reserve chamber) provided for the liquid ejecting head 26A. FIG. 8 is a cross-sectional view along a line VIII-VIII in FIG. 6.

The liquid ejecting apparatus according to the second embodiment includes the same configuration as that of the liquid ejecting apparatus 100 illustrated in FIG. 1 except for including the liquid ejecting head 26A instead of the liquid ejecting head 26.

As illustratively shown in FIG. 6, the liquid ejecting head 26A has the same configuration as that of the liquid ejecting head 26 illustrated in FIG. 2 except for including a housing 40A instead of the housing 40 and including a flow channel substrate 32A instead of the flow channel substrate 32.

The flow channel substrate 32A is a plate-shaped member that forms a flow channel for ink. As illustratively shown in FIGS. 6 to 8, a flow channel RC is formed in the flow channel substrate 32A. The flow channel RC includes flow channels RC1 and RC2. The flow channel RC1 is provided corresponding to the line L1, and the flow channel RC2 is provided corresponding to the line L2. The flow channel RC1 is an opening elongated in the Y-axis direction similarly to the flow channel RA1. The flow channel RC2 is an opening which is located on the +X side of the flow channel RC1 and is elongated in the Y-axis direction similarly to the flow channel RA2. The flow channel RC, which is provided for the flow channel substrate 32A, is different from the flow channel RA, which is provided for the flow channel substrate 32, in not including the flow channels RA3 and RA4.

The housing 40A includes the same configuration as that of the housing 40 illustrated in FIGS. 2 to 4 except for including an opening 44A (see FIG. 6) instead of the opening 44, including an absorber 46A instead of the two absorbers 46 (see FIG. 6), and including a flow channel RD (see FIG. 7) instead of the flow channel RB.

Figure 7:
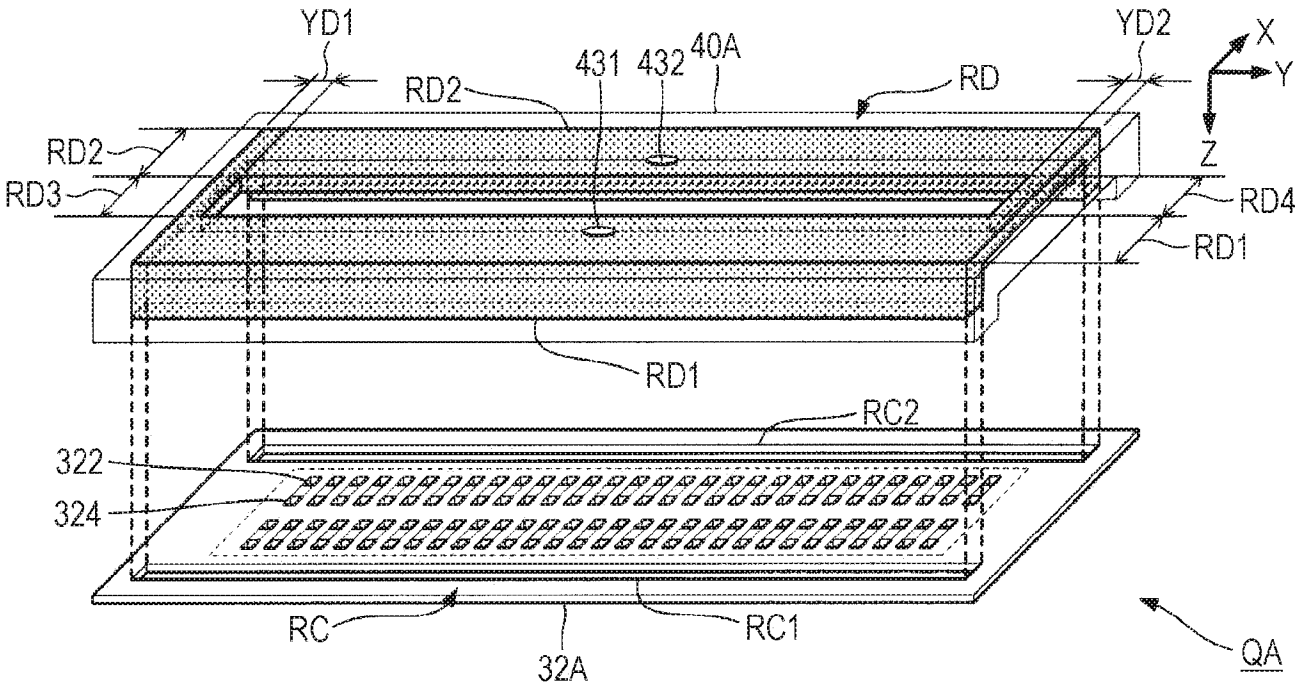
FIG. 7 is an exploded perspective view of a reservoir.
Figure 8:
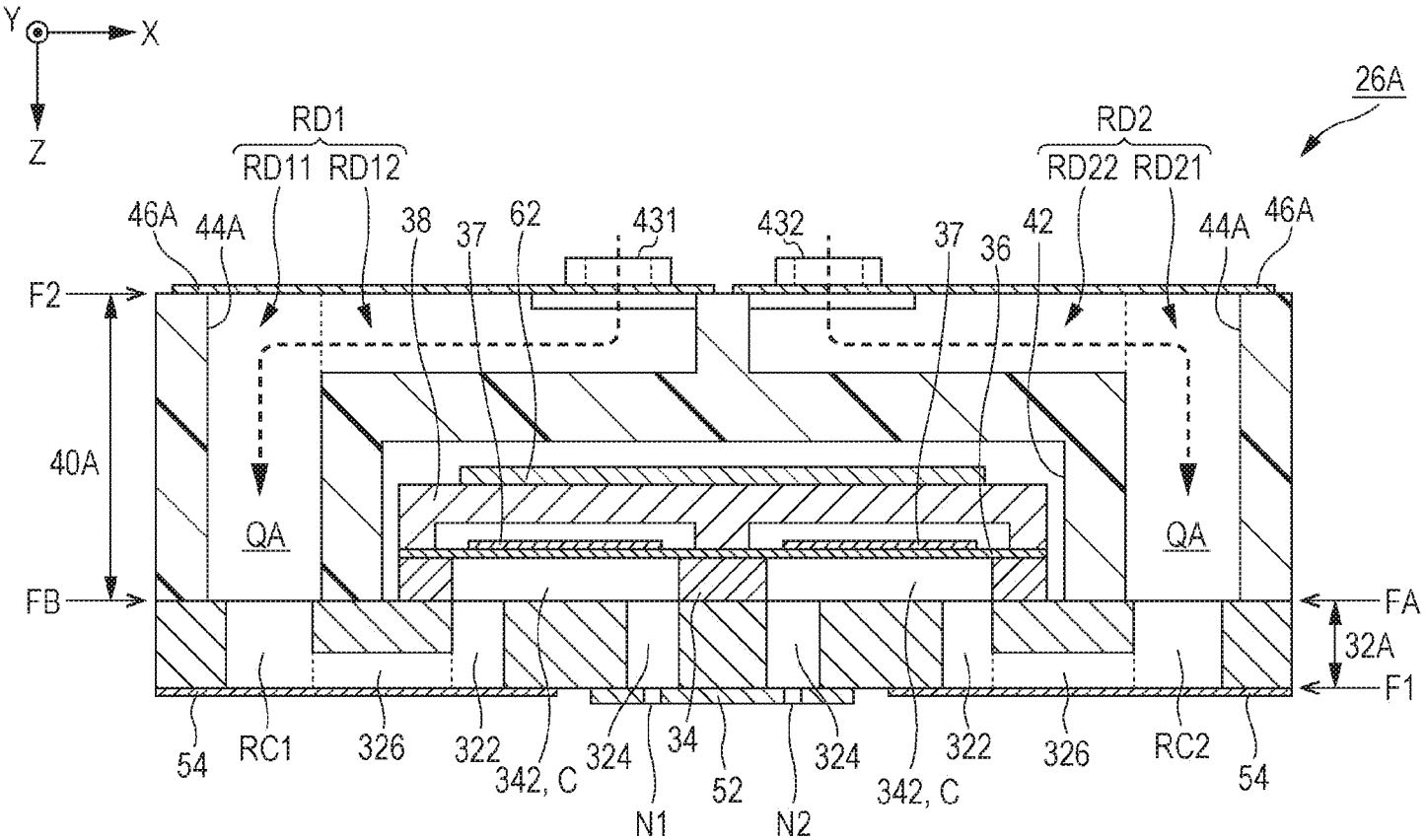
FIG. 8 is a cross-sectional view of the liquid ejecting head.

As illustratively shown in FIGS. 7 and 8, the flow channel RD is formed in the housing 40A. The flow channels RC and RD function as the reservoir QA, which reserves ink to be supplied to the 2M pressure chambers C.

The flow channel RD includes: a flow channel RD1, which communicates with the flow channel RC1; a flow channel RD2, which communicates with the flow channel RC2; a flow channel RD3, which connects the flow channels RD1 and RD2; and a flow channel RD4, which connects the flow channels RD1 and RD2.

The flow channel RD1 is an opening elongated in the Y-axis direction and includes flow channels RD11 and RD12. The flow channel RD11 communicates with the flow channel RC1; and the flow channel RD12 communicates with the feed port 431. The flow channel RD2 is an opening which is located on the +X side of the flow channel RD1 and is elongated in the Y-axis direction. The flow channel RD2 includes: a flow channel RD21, which communicates with the flow channel RC2; and a flow channel RD22, which communicates with the feed port 432. The flow channel RD3 is an opening formed so as to connect an end of the flow channel RD1 on the −Y side, which is located in a region YD1 (see FIG. 7), and an end of the flow channel RD2 on the −Y side, which is located in the region YD1. The flow channel RD4 is an opening formed so as to connect an end of the flow channel RD1 on the +Y side, which is located in a region YD2 (see FIG. 7), and an end of the flow channel RD2 on the +Y side, which is located in the region YD2.

As indicated by dashed arrows in FIG. 8, ink supplied from the liquid container 14 to the feed port 431 flows into the flow channel RC1 through the flow channels RD12 and RD11. A part of the ink having flown into the flow channel RC1 is supplied to the pressure chamber C corresponding to the nozzle N1 through the corresponding flow channels 326 and 322. The ink having filled the pressure chamber C corresponding to the nozzle N1 flows through the corresponding flow channels 324 in the +Z direction, for example, to be ejected through the nozzle N1.

The ink supplied from the liquid container 14 to the feed port 432 flows into the flow channel RC2 through the flow channels RD22 and RD21. A part of the ink having flown into the flow channel RC2 is supplied to the pressure chamber C corresponding to the nozzle N2 through the corresponding flow channels 326 and 322. The ink having filled the pressure chamber C corresponding to the nozzle N2 flows through the corresponding flow channel 324 in the +Z direction, for example, to be ejected through the nozzle N2.

As illustratively shown in FIG. 7, the flow channel RD is an annular flow channel. More specifically, as described above, the end of the flow channel RD1 on the −Y side and the end of the flow channel RD2 on the −Y side are connected by the flow channel RD3, and the end of the flow channel RD1 on the +Y side and the end of the flow channel RD2 on the +Y side are connected by the flow channel RD4. This forms a circulation route of: "the flow channel RD1→the flow channel RD3→the flow channel RD2→the flow channel RD4→the flow channel RD1", for example. Accordingly, ink supplied to the flow channels RD1 and RD2 through the feed ports 431 and 432 can circulate within the flow channel RD.

As illustratively shown in FIG. 8, in the second embodiment, the integrated circuit 62 and protection member 38 are provided between the flow channels RD11 and RD21. In the second embodiment, heat generated from the integrated circuit 62 is dissipated through the ink within the reservoir QA even when the integrated circuit 62 and protection member 38 are not directly exposed to the air outside of the liquid ejecting head 26.

Third Embodiment

Hereinafter, a description is given of a liquid ejecting apparatus according to a third embodiment with reference to FIGS. 9 to 11. In each mode illustratively shown in the following description, the elements providing the same operations or functions as those of the first or second embodiment are given the same reference numerals as those used in the description of the first or second embodiment. The detailed description thereof are properly omitted.

Figure 9:
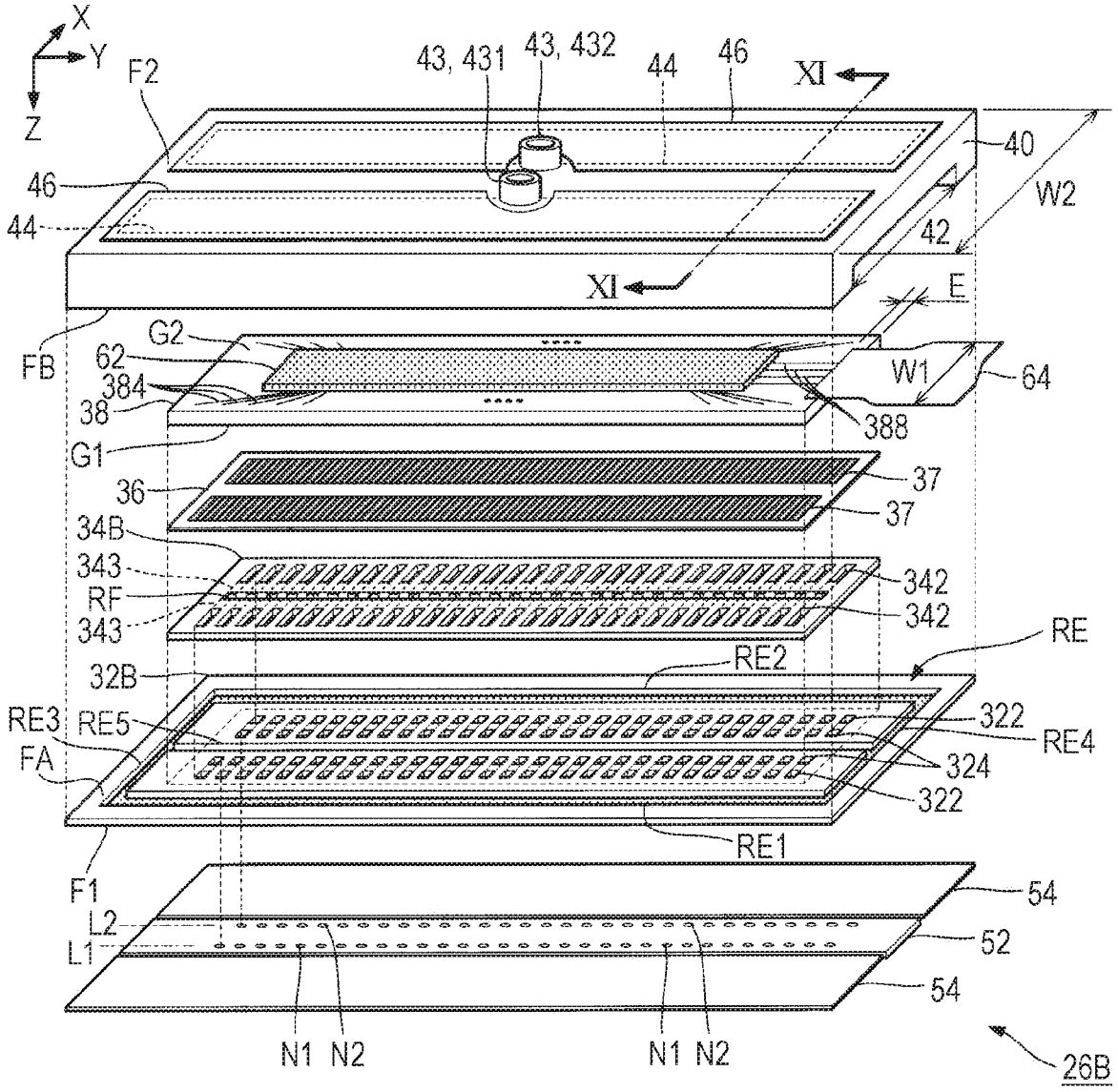
FIG. 9 is an exploded perspective view of a liquid ejecting head according to a third embodiment.

FIG. 9 is an exploded perspective view of a liquid ejecting head 26B which is provided for the liquid ejecting apparatus according to the third embodiment. FIG. 10 is an exploded perspective view for explaining a reservoir QB (another example of the reserve chamber) provided for the liquid ejecting head 26B. FIG. 11 is a cross-sectional view along a line XI-XI in FIG. 9.

The liquid ejecting apparatus according to the third embodiment includes the same configuration as that of the liquid ejecting apparatus 100 illustrated in FIG. 1 except for including the liquid ejecting head 26B instead of the liquid ejecting head 26.

As illustratively shown in FIG. 9, the liquid ejecting head 26B includes the same configuration as that of the liquid ejecting head 26 (illustrated in FIG. 2) except for including a flow channel substrate 32B instead of the flow channel substrate 32 and including a pressure chamber substrate 34B instead of the pressure chamber substrate 34.

The flow channel substrate 32B is a plate-shaped member that forms a flow channel for ink. As illustratively shown in FIGS. 9 to 11, a flow channel RE is formed in the flow channel substrate 32B.

The flow channel RE includes: a flow channel RE1, which is provided corresponding to the line L1; a flow channel RE2, which is provided corresponding to the line L2; a flow channel RE3, which connects the flow channels RE1 and RE2; a flow channel RE4, which connects the flow channels RE1 and R32; and a flow channel RE5, which connects the flow channels RE3 and RE4.

The flow channel RE1 is an opening elongated in the Y-axis direction similarly to the flow channel RA1. The flow channel RE2 is an opening which is located on the +X side of the flow channel RE1 and is elongated in the Y-axis direction similarly to the flow chart RA2. The flow channel RE3 is an opening which is formed so as to connect an and of the flow channel RE1 on the −Y side, which is located in a region YE1 (see FIG. 10), to an end of the flow channel RE2 on the −Y side, which is located in the region YE1, similarly to RA3. The flow channel RE4 is an opening which is formed so as to connect an end of the flow channel RE1 on the +Y side, which is located in a region YE2 (see FIG. 10), and an end of the flow channel RE2 on the +Y side, which is located in the region YE2, similarly to RA4. The flow channel RE5 is an opening which is located between the flow channels RE1 and RE2 and is elongated in the Y-axis direction.

The flow channel RE, which is provided for the flow channel substrate 32B, is different from the flow channel RA (see FIG. 2), which is provided for the flow channel substrate 32, in including the flow channel RE5.

In the third embodiment, the flow channel RB5 is located between the nozzles N1 and nozzles N2 in a plan view.

The pressure chamber substrate 34B includes: 2M openings 342, corresponding one-to-one to the 2M nozzles N; a flow channel RF, which communicates with the flow channel RE5; and the 2M flow channels 343, which are provided corresponding one-to-one to the 2M openings 342 in order to connect the 2M openings 342 and flow channel RF. The pressure chamber substrate 34B includes the same configuration as that of the pressure chamber substrate 34 (illustrated in FIGS. 2 and 4) except for including the flow channel RF and including the 2M flow channels 343.

In the third embodiment, the flow channel RF is located between the nozzles N1 and nozzles N2 in a plan view.

Figure 11:
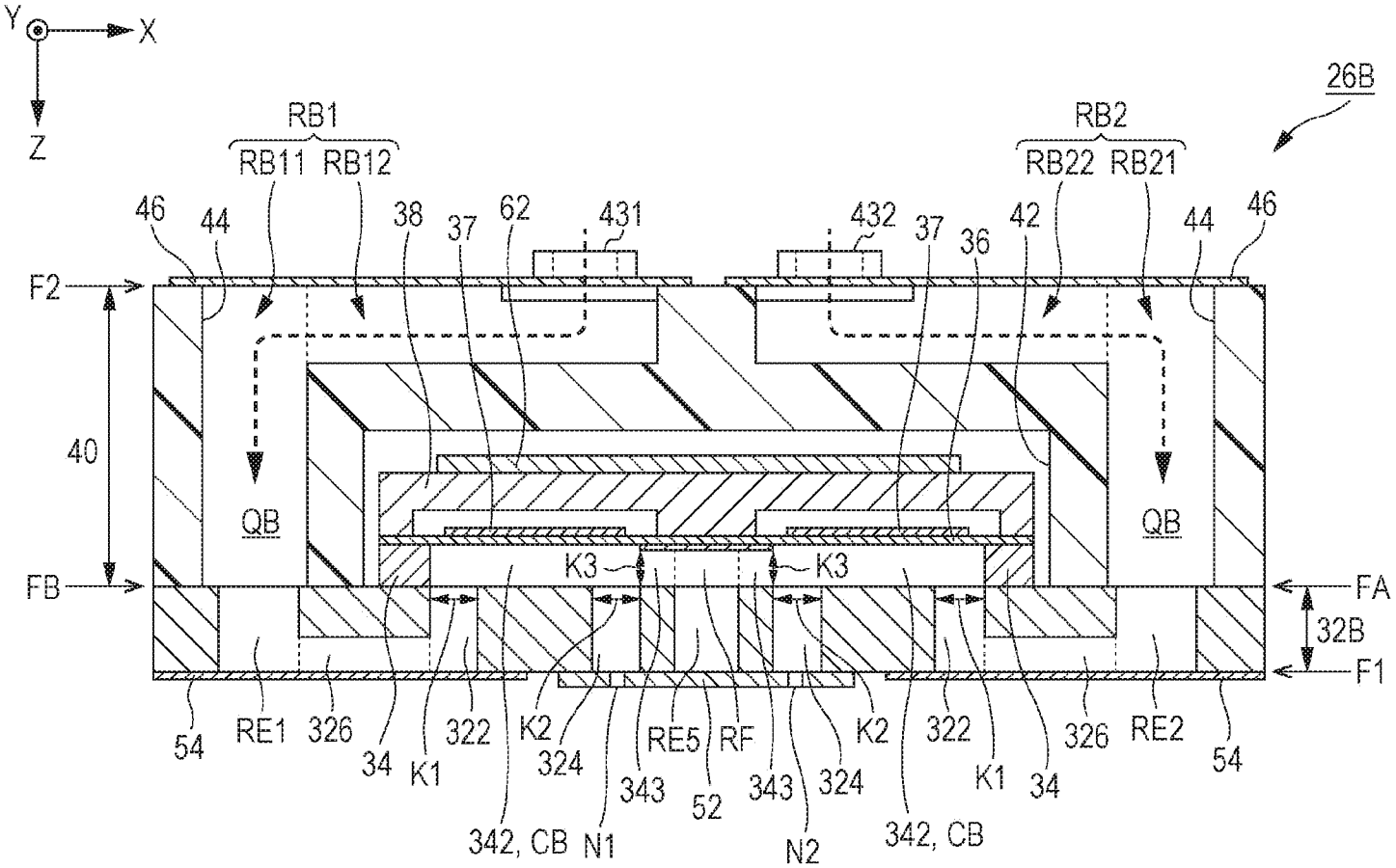
FIG. 11 is a cross-sectional view of the liquid ejecting head.

As illustratively shown in FIG. 11, the space located between the face FA of the flow channel substrate 32B and the vibration unit 36 in each opening 342 functions as a pressure chamber CB for applying pressure to ink filling the space. Each pressure chamber CB includes: a communicating port K1, which communicates with the corresponding flow channel 322; a communicating port K2, which communicates with the corresponding flow channel 324; and a communicating port K13, which communicates with the corresponding flow channel 343. The pressure chamber CB includes the same configuration as that of the pressure chamber C (illustrated in FIG. 4) except for including the communicating port K3. In the third embodiment, the cross-sectional area of the communicating port K1 is larger than that of the communicating port K3.

Figure 10:
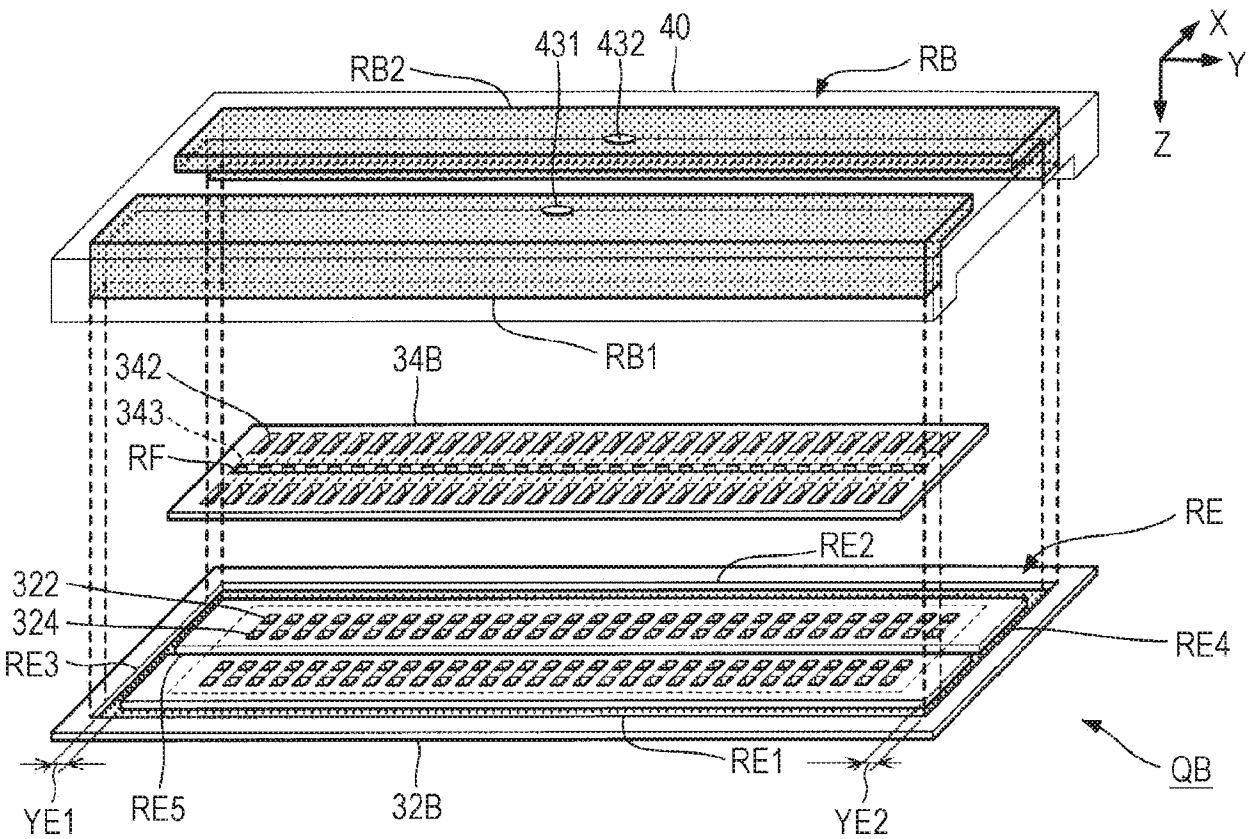
FIG. 10 is an exploded perspective view of a reservoir.

As illustratively shown in FIG. 10, the housing 40, which is provided for the liquid ejecting head 26B, includes a flow channel RB. In the third embodiment, the flow channels RB, RE, and RF function as a reservoir QB, which reserves ink to be supplied to the 2M pressure chambers CB.

As indicated by dashed arrows in FIG. 11, ink supplied from the liquid container 14 to the feed port 431 flows into the flow channel RE1 through the flow channels RB12 and RB11. A part of the ink having flown into the flow channel RE1 is supplied to the pressure chamber CB corresponding to the nozzle N1, through the corresponding flow channels 326 and 322 and communicating port K1. The ink having filled the pressure chamber CB corresponding to the nozzle N1 flows through one or both of the corresponding communicating ports K2 and K3. The ink having flown out through the communicating port K2 of the pressure chamber CB corresponding to the nozzle N1 flows through the corresponding flow channel 324 in the +z direction to be ejected through the nozzle N1. The ink having flow through the communicating port K3 of the pressure chamber CB corresponding to the nozzle N1 flows to the flow channel RE5 through the corresponding flow channel 343 and the flow channel RF.

Ink supplied from the liquid container 14 to the feed port 432 flows into the flow channel RE2 through the flow channels RB22 and RB21. A part of the ink having flown into the flow channel RE2 is supplied to the pressure chamber CB corresponding to the nozzle N2, through the corresponding flow channels 326 and 322 and communicating port K1. The ink having filled the pressure chamber CB corresponding to the nozzle N2 flows through one or both of the corresponding communicating ports K2 and K3. The ink having flown through the communicating port K2 of the pressure chamber CB corresponding to the nozzle N2 flows through the flow channel 324 in the +Z direction to be ejected through the nozzle N2. The ink having flown out through the communicating port K3 of the pressure chamber CB corresponding to the nozzle N2 flows to the flow channel RE5 through the corresponding flow channel 343 and the flow channel RF.

As illustratively shown in FIGS. 9 and 10, the flow channel RE5 communicates with the flow channels RE1 and RE2 through the flow channel RE3 or RE4. Ink having flown into the flow channel RE5 therefore circulates through the flow channel RE3 or RE4 to the flow channel RE1 or RE2. In the third embodiment, the liquid ejecting head 26B includes at least circulation routes of: "the flow channel RE1→the flow channels 326→the flow channels 322→the communicating ports K1→the pressure chambers CB→the communicating ports K3→the flow channels 343→the flow channel RF→the flow channel RE5→the flow channel RE3 or RE4→the flow channel RE11"; and "the flow channel RE2→the flow channels 326→the flow channels 322→the communicating ports K1→the pressure chambers CB→the communicating ports K3→the flow channels 343→the flow channel RF→the flow channel RE5→the flow channel RE3 or RE4→the flow channel RE2". In other words, at least a part of the ink supplied to each pressure chamber CB through the communicating port K1 flows out through the communicating port K3 to be circulated.

In the third embodiment, moreover, the liquid ejecting head 26B includes circulation routes of: "the flow channel RE5→the flow channel RE3 or RE4→the flow channel RE1 or RB2→the flow channel RE4 or RE3→the flow channel RB5"; and "the flow channel RE1→the flow channel RE3→the flow channel RE2→the flow channel RE4→the flow channel RE1".

As illustratively shown in FIG. 11, in the third embodiment, the integrated circuit 62 and protection member 38 are provided between the flow channels RB11 and RB21. In the third embodiment, therefore, heat generated from the integrated circuit 62 can be efficiently dissipated through the ink within the reservoir QB even when the integrated circuit 62 and protection member 38 are not directly exposed to the air outside of the liquid ejecting head 26B.

In the third embodiment, the ink flows from the communicating port K1 to at least one of the communicating ports K2 and K3 in each pressure chamber CB. The protection member 38 is provided over the ejecting sections including the pressure chambers CB. In the third embodiment, therefore, heat generated from the integrated circuit 62 can be dissipated through the ink within the pressure chambers CB.

In the third embodiment, at least one of the flow channels RE1 and RE2 is an example of the first flow channel, and the flow channels RF and RE5 are an example of the second flow channel.

In the third embodiment, the communicating port K1 is an example of an inlet port through which the ink within the reservoir QB flows to each pressure chamber CB. The communicating port K2 is an example of a supply port through which ink within each pressure chamber CB is supplied to the flow channel 324. The communicating port K3 is an example of an outlet port through which ink within each pressure chamber CB flows to the reservoir QB.

Fourth Embodiment

Hereinafter, a description is given of a liquid ejecting apparatus according to a fourth embodiment with reference to FIGS. 12 to 14. In each mode illustratively shown in the following description, the elements providing the same operations or functions as those of the first to third embodiments are given the same reference numerals as those used in the description of the first to third embodiments. The detailed description thereof are properly omitted.

Figure 12:
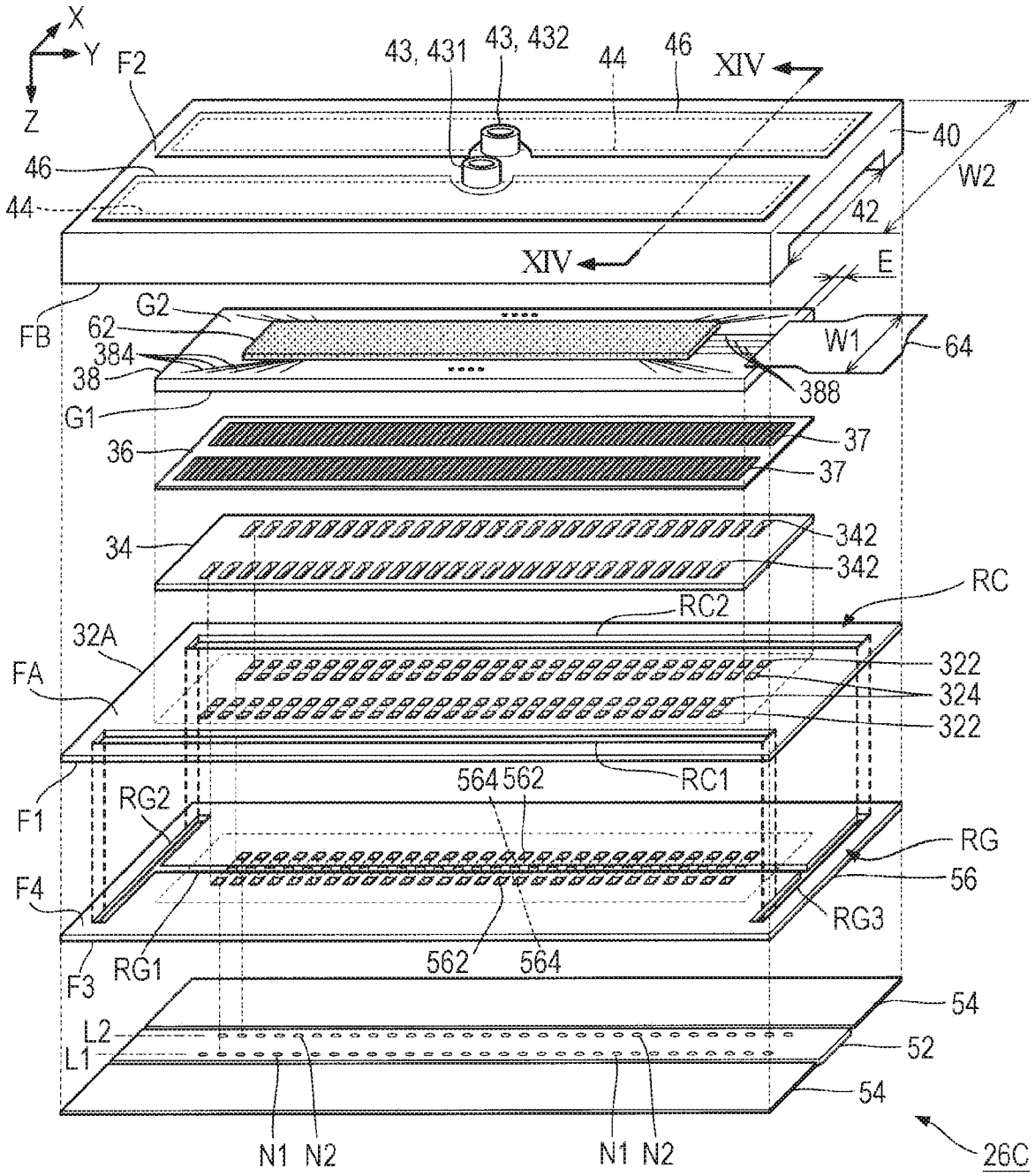
FIG. 12 is an exploded perspective view of a liquid ejecting head according to a fourth embodiment.

FIG. 12 is an exploded perspective view of a liquid ejecting head 26C which is provided for the liquid ejecting apparatus according to the fourth embodiment. FIG. 13 is an exploded perspective view for explaining a reservoir QC (another example of the reserve chamber) provided for the liquid ejecting head 26C. FIG. 14 is a cross-sectional view along a line XIV-XIV in FIG. 12.

The liquid ejecting apparatus according to the fourth embodiment includes the same configuration as that of the liquid ejecting apparatus 100 illustrated in FIG. 1 except for including the liquid ejecting head 26C instead of the liquid ejecting head 26.

As illustratively shown in FIG. 12, the liquid ejecting head 26B includes the same configuration as that of the liquid ejecting head 26 (illustrated in FIG. 2) except for including the flow channel substrate 56 and including the flow channel substrate 32A, which is described in the second embodiment, instead of the flow channel substrate 32. The liquid ejecting head 26B includes the housing 40, that includes the flow channel RB, and the flow channel substrate 32A, that includes a flow channel RC.

The flow channel substrate 56 is a plate-shaped member that forms a flow channel for ink. The flow channel substrate 56 is produced by processing a silicon (Si) single crystal substrate using a semiconductor manufacturing technique, for example. Any publicly-known materials and processes can be employed to manufacture the flow channel substrate 56.

On the face F3 of the flow channel substrate 56 on the +Z side, the nozzle plate 52 and vibration absorbers 54 are provided. The face 74 of the flow channel substrate 56 on the −Z side is joined to the face F1 of the flow channel substrate 32A.

Figure 13:
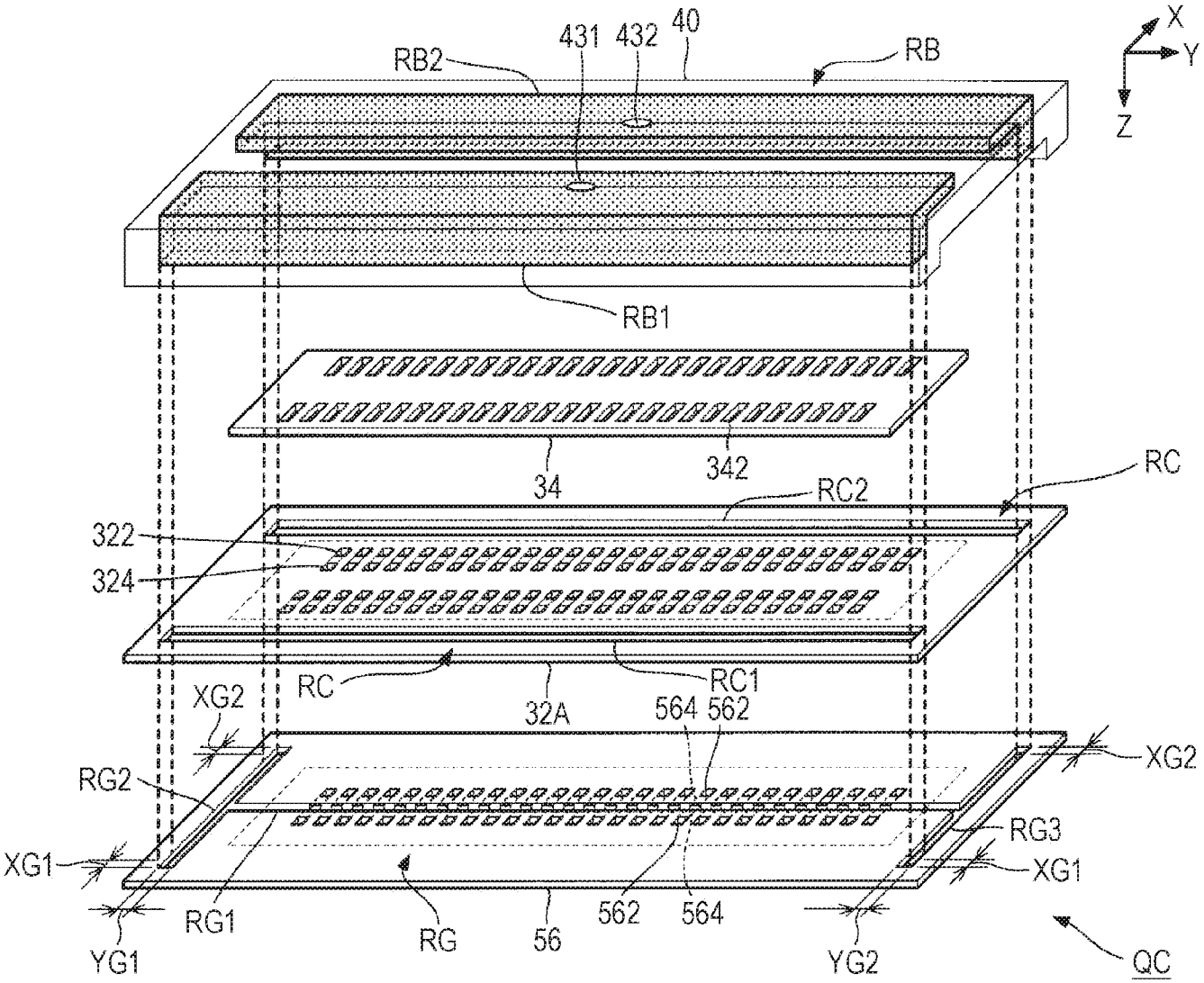
FIG. 13 is an exploded perspective view of a reservoir.
Figure 14:
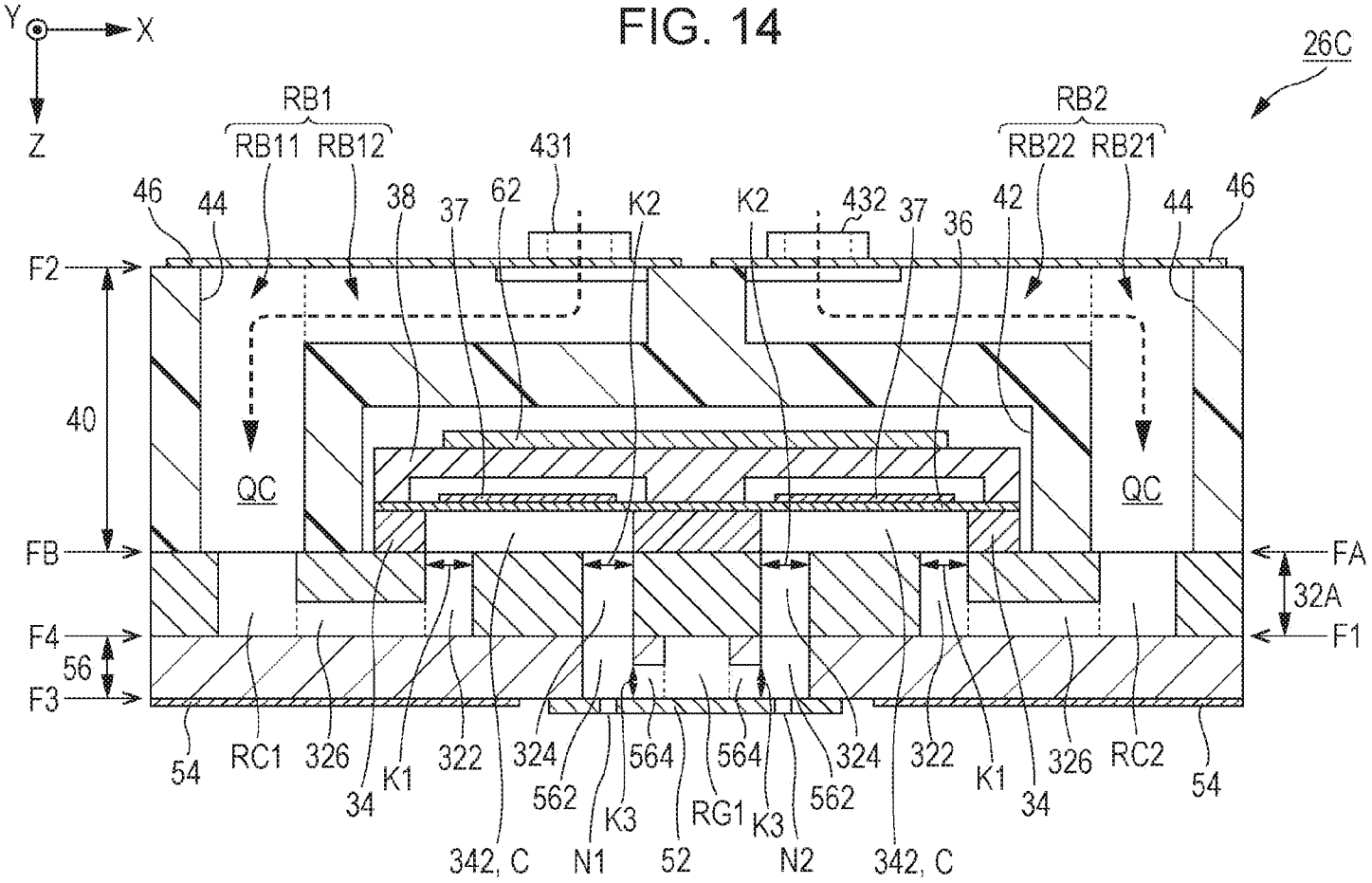
FIG. 14 is a cross-sectional view of the liquid ejecting head.

As illustratively shown in FIGS. 12 to 14, a flow channel RG is formed in the flow channel substrate 56.

The flow channel RG includes a flow channel RG1, a flow channel RG2, and a flow channel RG3. The flow channel RG2 is an opening elongated in the X-axis direction. The flow channel RG2 communicates with the flow channel RC1, which is provided in the flow channel substrate 32A, in a region XG1 at the end on the −X side and communicates with the flow channel RC2, which is provided in the flow channel substrate 32A, in a region XG2 at the end on the +X side. The flow channel RG3 is an opening which is located on the +Y side of the flow channel RG2 and is elongated in the X-axis direction. The flow channel RG3 communicates with the flow channel RC1 in the region XG1 while communicating with the flow channel RC2 in the region XG2. The flow channel RG1 is an opening elongated in the Y-axis direction and connects the flow channels RG2 and RG3. In the fourth embodiment, the flow channel RG1 is located between the nozzles N1 and N2 in a plan view.

In the fourth embodiment, the flow channels RB, RC, and RG function as a reservoir QC, which reserves ink to be supplied to the 2M pressure chambers C.

As illustratively shown in FIGS. 12 to 14, the flow channel substrate 56 includes: 2M flow channels 562, which are provided corresponding one-to-one to the 2M nozzles N; and 2M flow channels 564, which are provided corresponding one-to-one to the 2M nozzles N. As illustratively shown in FIG. 14, the flow channels 562 connect the flow channels 324, which are provided for the flow channel substrate 32A, to the respective nozzles N. In the fourth embodiment, the flow channel including each flow channel 324 and the flow channel 562 corresponding thereto is an example of a communicating flow channel. The flow channels 564 connect the respective flow channels 562 to the flow channel RG1.

As illustratively shown in FIG. 14, the space located between the face FA of the flow channel substrate 32A and the vibration unit 36 within each opening 342 functions as the pressure chamber C for applying pressure to the ink filling the space. Each pressure chamber C includes: the communicating port K1, which communicates with the corresponding flow channel 322; and the communicating port K2, which communicates with the corresponding flow channel 324. Each flow channel 562 includes the communicating port K3, which communicates with the corresponding flow channel 564. In the fourth embodiment, the cross-sectional area of the communicating port K1 is larger than that of the communicating port K3.

As indicated by dashed arrows in FIG. 14, ink supplied from the liquid container 14 to the feed port 431 flows into the flow channel RC1 through the flow channels RB12 and RB11. A part of the ink having flown into the flow channel RC1 is supplied to the pressure chamber C corresponding to the nozzle N1, through the corresponding flow channels 326 and 322 and communicating port K1. The ink having filled the pressure chamber C corresponding to the nozzle N1 flows into the corresponding flow channel 562 through the communicating port K2 and flow channel 324. The ink within the flow channel 562 flows to one or both of the nozzle N1 and communicating port K3. The ink having flown out through the communicating port K3 of the flow channel 562 flows into the flow channel RG1 through the corresponding flow channel 564.

Ink supplied from the liquid container 14 to the feed port 432 flows into the flow channel RC2 through the flow channels RB22 and RB21. A part of the ink having flown into the flow channel RC2 is supplied to the pressure chamber C corresponding to the nozzle N2, through the corresponding flow channels 326 and 322 and communicating port K1. The ink having filled the pressure chamber C corresponding to the nozzle N2 flows into the corresponding flow channel 562 through the corresponding communicating port K2 and flow channel 324. The ink within the flow channel 562 flows to one or both of the nozzle N2 and communicating port K3. The ink having flown out through the communicating port K3 of the flow channel 562 flows into the flow channel RG1 through the corresponding flow channel 564.

As illustratively shown in FIGS. 12 and 13, the flow channel RG1 communicates with the flow channels RC1 and RC2 through the flow channels RG2 and RG3. Ink having flown into the flow channel RG1 flows through the flow channel RG2 or RG3 and circulates to the flow channels RC1 or RC2. In the fourth embodiment, the liquid ejecting head 26B includes at least circulation routes of: "the flow channel RC1→the flow channels 326→the flow channels 322→the communicating ports K1→the pressure chambers C→the communicating ports K2→the flow channels 324→the flow channels 562→the communicating ports K3→the flow channels 564→the flow channel RG1→the flow channel RG2 or RG3→the flow channel RC1"; and "the flow channel RC2→the flow channels 326→the flow channels 322→the communicating ports K1→the pressure chambers C→the communicating ports K2→the flow channels 324→the flow channels 562→the communicating ports K3→the flow channels 564→the flow channel RG1→the flow channel RG2 or RG3→the flow channel RC2". In other words, at least a part of ink supplied to each pressure chamber C through the communicating port K1 flows out of the communicating port K3 through the communicating port K2, flow channel 324, and flow channel 562 to be circulated.

In the fourth embodiment, the liquid ejecting head 26C includes a circulation route of "the flow channel RC1→the flow channel RG2→the flow channel RC2→the flow channel RG3→the flow channel RC1", for example.

As illustratively shown in FIG. 14, in the fourth embodiment, the integrated circuit 62 and protection member 38 are provided between the flow channels RB11 and RB21. In the fourth embodiment, therefore, heat generated from the integrated circuit 62 can be efficiently dissipated through the ink within the reservoir QC even when the integrated circuit 62 and protection member 38 are not directly exposed to the air outside of the liquid ejecting head 26B.

In the fourth embodiment, at least a part of the ink within each pressure chamber C and corresponding communicating flow channel flows through the communicating ports K1 and K2 to the communicating port K3. The protection member 38 is provided over the ejecting sections including the pressure chambers C. In the fourth embodiment, therefore, heat generated from the integrated circuit 62 can be dissipated through the ink within the pressure chambers C.

In the fourth embodiment, at least one of the flow channels RC1 and RC2 is an example of the first flow channel, and the flow channel RG1 is an example of the second flow channel.

In the fourth embodiment, the communicating port K1 is an example of an inlet port through which the ink within the reservoir QC flows to each pressure chamber C. The communicating port K2 is an example of a supply port through which ink within each pressure chamber C is supplied to the flow channel 324 and the flow channel 562. The communicating port K3 is an example of an outlet port through which ink within each the flow channel 562 flows to the reservoir QC.

Fifth Embodiment

Hereinafter, a description is given of a liquid ejecting apparatus according to a fifth embodiment with reference to FIGS. 15 and 16. In each mode illustratively shown in the following description, the elements providing the same operations or functions as those of the first to fourth embodiments are given the same reference numerals as those used in the description of the first to fourth embodiments. The detailed description thereof are properly omitted.

Figure 15:
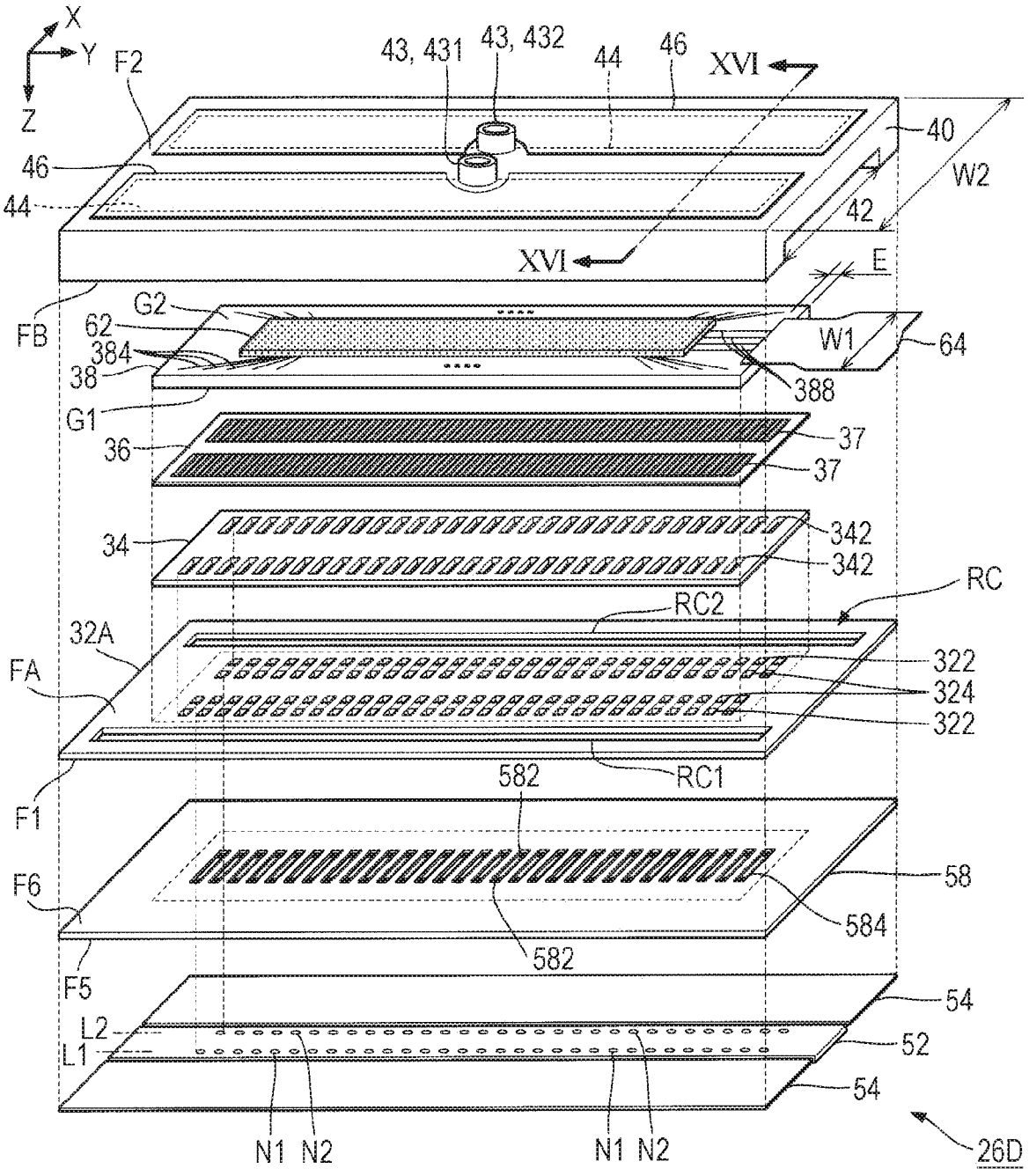
FIG. 15 is an exploded perspective view of a liquid ejecting head according to a fifth embodiment.

FIG. 15 is an exploded perspective view of a liquid ejecting head 26D provided for the liquid ejecting apparatus according to the fifth embodiment. FIG. 16 is a cross-sectional view taken along a line XVI-XVI in FIG. 15.

The liquid ejecting apparatus according to the fifth embodiment includes the same configuration as that of the liquid ejecting apparatus 100 illustrated in FIG. 1 except for including the liquid ejecting head 26D instead of the liquid ejecting head 26.

As illustratively shown in FIG. 15, the liquid ejecting head 26D includes the same configuration as that of the liquid ejecting head 26 (illustrated in FIG. 2) except for including the flow channel substrate 58 and including the flow channel substrate 32A instead of the flow channel substrate 32. The liquid ejecting head 26D includes the housing 40, that includes the flow channel RB, and the flow channel substrate 32A, that includes a flow channel RC. In the fifth embodiment, the flow channels RB and RC function as a reservoir QD (another example of the reserve chamber) that reserves ink to be supplied to the 2M pressure chambers C.

The flow channel substrate 58 is a plate-shaped member that forms a flow channel for ink. The flow channel substrate 58 is produced by processing a silicon (Si) single crystal substrate using a semiconductor manufacturing technique, for example. Any publicly-known materials and processes can be employed to manufacture the flow channel substrate 58.

On the face F5 of the flow channel substrate 58 on the +Z side, the nozzle plate 52 and vibration absorbers 54 are provided. The face F6 of the flow channel substrate 58 on the −Z side is joined to the face F1 of the flow channel substrate 32A.

Figure 16:
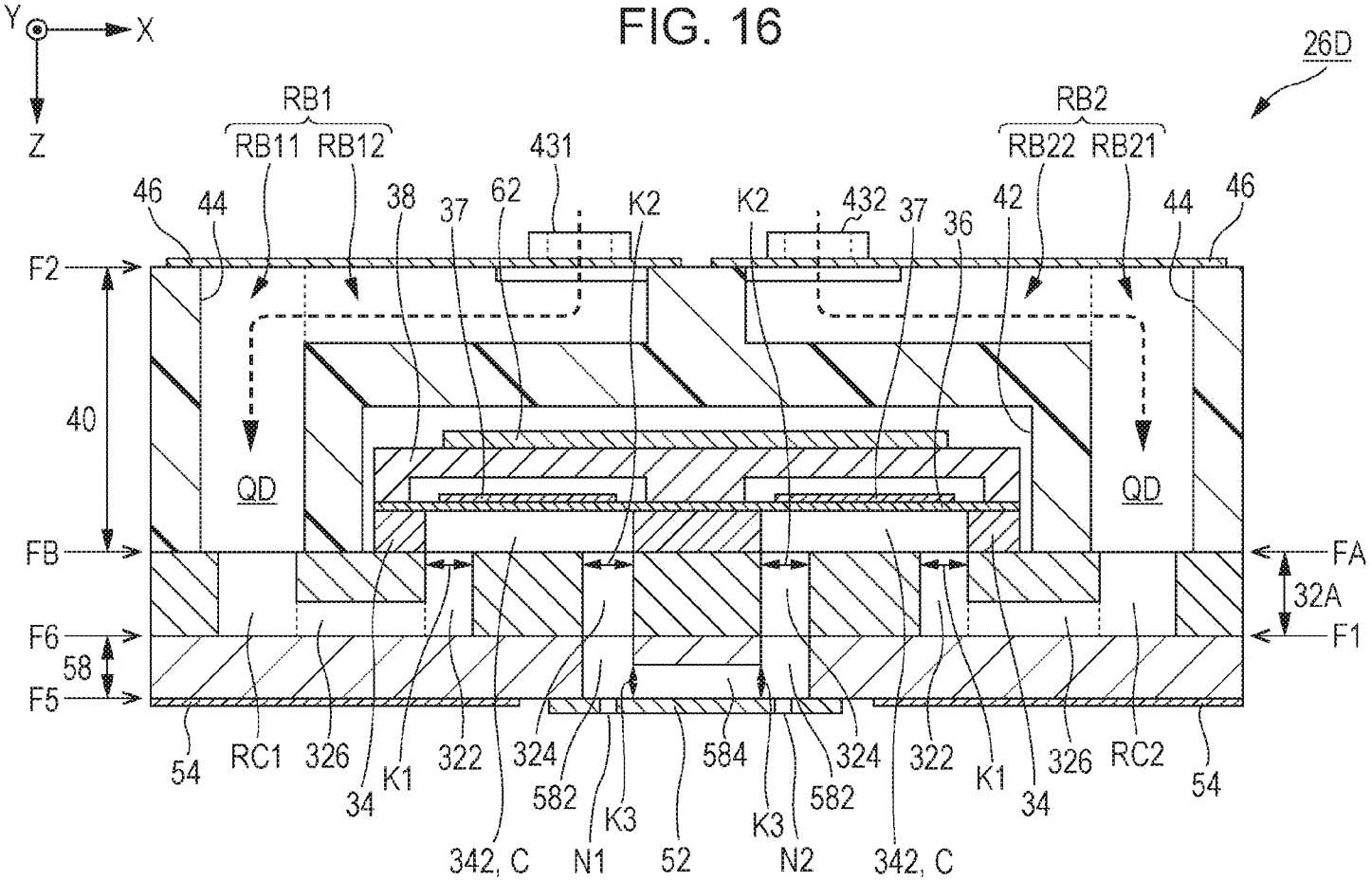
FIG. 16 is a cross-sectional view of the liquid ejecting head.

As illustratively shown in FIGS. 15 and 16, the flow channel substrate 58 includes 2M flow channels 582 provided corresponding one-to-one to the 2M nozzles N. As illustratively shown in FIG. 16, the flow channels 582 connect the flow channels 324, which are provided in the flow channel substrate 32A, and the nozzles N. In the fifth embodiment, the flow channel including each flow channel 324 and the corresponding flow channel 582 is an example of the communicating flow channel. The flow channel substrate 58 includes the M flow channels 584 (an example of a link flow channel) which connect the flow channels 582 corresponding to the nozzles N1 and the flow channels 582 corresponding to the nozzles N2.

As illustratively shown in FIG. 16, the space located between the face FA of the flow channel substrate 32A and the vibration unit 36 within each opening 342 functions as the pressure chamber C for applying pressure to the ink filling the space. Each pressure chamber C includes: the communicating port K1, which communicates with the corresponding flow channel 322; and the communicating port K2, which communicates with the corresponding flow channel 324. Each flow channel 582 includes the communicating port K3, which communicates with the corresponding flow channel 584. In the fifth embodiment, the cross-sectional area of the communicating port K1 is larger than that of the communicating port K3.

As indicated by dashed arrows in FIG. 16, ink supplied from the liquid container 14 to the feed port 431 flows into the flow channel RC1 through the flow channels RB12 and RB11. A part of the ink having flown into the flow channel RC1 is supplied to the pressure chamber C corresponding to the nozzle N1, through the corresponding flow channels 326 and 322 and communicating port K1. The ink having filled the pressure chamber C corresponding to the nozzle N1 flows into the corresponding flow channel 582 through the communicating port K2 and flow channel 324. The ink within the flow channel 582 flows to one or both of the nozzle N1 and communicating port K3. The ink having flown out through the communicating port K3 of the flow channel 582 flows into the pressure chamber C corresponding to the nozzle N2 through the flow channel 584 and the flow channels 582 and 324 corresponding to the nozzles N2.

Ink supplied from the liquid container 14 to the feed port 432 flows into the flow channel RC2 through the flow channels RB22 and RB21. A part of the ink having flown into the flow channel RC2 is supplied to the pressure chamber C corresponding to the nozzle N2, through the corresponding flow channels 326 and 322 and communicating port K1. The ink having filled the pressure chamber C corresponding to the nozzle N2 flows into the corresponding flow channel 582 through the corresponding communicating port K2 and flow channel 324. The ink within the flow channel 582 flows to one or both of the nozzle N2 and communicating port K3. The ink having flown out through the communicating port K3 of the flow channel 582 flows into the pressure chamber C corresponding to the nozzle N1 through the flow channel 584 and the flow channels 582 and 324 corresponding to the nozzles N1.

As illustratively shown in FIGS. 15 and 16, ink in the liquid ejecting head 26D can be flown through a route of "the flow channel RC1→the flow channels 326→the flow channels 322→the communicating ports K1→the pressure chambers C corresponding to the nozzles N1→the communicating ports K2→the flow channels 324 corresponding to the nozzles N1→the flow channels 582 corresponding to the nozzles N1→the communicating ports K3→the flow channels 584→the communicating ports K3→the flow channels 582 corresponding to the nozzles N2→the flow channels 324 corresponding to the nozzles N2→communicating ports K2→the pressure chambers C corresponding to the nozzles N2→the communicating ports K1→the flow channels 322→the flow channels 326→the flow channel RC2" or the reverse route.

In order to cause ink to flow along these routes, the controller 20 may displace in the +Z direction, the piezoelectric element 37 corresponding to one of the paired nozzles N which communicate through each flow channel 584 while displacing in the −Z direction, the piezoelectric element 37 corresponding to the other nozzle N.

The liquid ejecting head 26D according to the fifth embodiment includes the configuration in which both of the paired flow channels 582 connected by each flow channel 584 communicate with the nozzles N. However, the invention is not limited to such a mode. The liquid ejecting head 26D may have a configuration in which only the nozzle N corresponding to one of the paired flow channels 582 connected by each flow channel 584 is provided while the nozzle N corresponding to the other flow channel 582 is not provided.

As described above, in the fifth embodiment, at least a part of the ink in the liquid ejecting head 26D flows through the communicating ports K1 and K2 to the communicating port K3 in each pressure chamber C and the communicating flow channel corresponding thereto. Moreover, the protection member 38 is provided over the ejecting section including the pressure chamber C. In the fifth embodiment, heat generated from the integrated circuit 62 can be dissipated through ink in the pressure chambers C.

In the fifth embodiment, the communicating port K1 is an example of the inlet port through which the ink within the reservoir QD flows to each pressure chamber C. The communicating port K2 is an example of the supply port through which the ink within each pressure chamber C is fed to the flow channels 324 and 582. The communicating port K3 is an example of the outlet port through which the ink within the flow channel 582 flows to the reservoir QD via the pressure chamber C.

In the fifth embodiment, the pressure chambers C provided corresponding to the nozzles N1 are an example of the first pressure chamber. The flow channels 326 and 322 connecting each of the pressure chambers C provided corresponding to the nozzles N1 to the flow channel RC1, are an example of a first connecting flow channel. The pressure chambers C provided corresponding to the nozzles N2 are an example of the second pressure chamber. The flow channels 326 and 322 connecting each of the pressure chambers C provided corresponding to the nozzles N2 to the flow channel RC2, are an example of a second connecting flow channel.

Modification

The embodiments illustratively described above can be variously modified. Some specific modifications are illustratively described below. Optionally selected two or more of the following modifications can be properly combined without conflicting with each other.

Modification 1

Each of the reservoirs (reservoirs Q, QA, QB, and QC) according to the aforementioned first to fourth embodiments may include a liquid mover, such as a pump, which causes ink to flow along the circulation route within the reservoir.

Modification 2

Each of the reservoirs and feed ports 43 according to the aforementioned first to fourth embodiments and modification 1 may include a structure in which ink flows along the circulation route within the reservoir.

In the first embodiment, for example, the flow channel RB11 may be designed to have an inclination with respect to the Z axis direction so that ink having flown from the flow channel RB11 to the flow channel RA1 travels through the flow channel RA1 in the −Y direction. The flow channel RB21 is designed to have an inclination opposite to that of the flow channel RB11 with respect to the Z-axis direction so that ink having flown from the flow channel RB21 to the flow channel RA2 travels through the flow channel RA2 in the +Y direction (see FIGS. 3 and 4). In this case, ink in the reservoir Q can be circulated along a circulation route of "the flow channel RA1→the flow channel RA3→the flow channel RA2→the flow channel RA4→the flow channel RA1".

In the second embodiment, for example, the feed port 431 may be designed to have an inclination with respect to the Z axis direction so that ink flowing from the feed port 431 to the flow channel RD1 travels through the flow channel RD1 in the −Y direction. The feed port 432 may be designed to have an inclination opposite to that of the feed port 431 with respect to the Z-axis direction so that ink flowing from the feed port 432 to the flow channel RD2 travels through the flow channel RD2 in the +Y direction (see FIG. 7). In this case, ink in the reservoir QA can be circulated along a circulation route of "the flow channel RD1→the flow channel RD3→the flow channel RD2→the flow channel RD4→the flow channel RD1".

In the third embodiment, for example, the flow channel RB11 may be designed to have an inclination with respect to the Z-axis direction so that ink flowing from the flow channel RB11 to the flow channel RE1 travels through the flow channel RE1 in the −Y direction. The flow channel RB21 may be designed to have an inclination opposite to that of the flow channel RB11 with respect to the Z-axis direction so that ink flowing from the flow channel RB21 to the flow channel RB2 travels through the flow channel RE2 in the +Y direction (see FIGS. 10 and 11). In this case, ink in the reservoir QB can be circulated along a circulation route of "the flow channel RE1→the flow channel RE3→the flow channel RE2→the flow channel RE4→the flow channel RE1".

In the fourth embodiment, for example, the flow channel RB11 may be designed to have an inclination with respect to the Z-axis direction so that ink flowing from the flow channel RB11 to the flow channel RC1 travels through the flow channel RC1 in the −Y direction. The flow channel RB21 may be designed to have an inclination opposite to that of the flow channel RB11 with respect to the Z-axis direction so that ink flowing from the flow channel RB21 to the flow channel RC2 travels through the flow channel RC2 in the +Y direction (see FIGS. 13 and 14). In this case, ink in the reservoir QC can be circulated along a circulation route of "the flow channel RC1→the flow channel RG2→the flow channel RC2→the flow channel RG3→the flow channel RC1".

Modification 3

The liquid ejecting apparatuses illustratively shown in the aforementioned embodiments and modifications are serial-type liquid ejecting apparatuses each of which reciprocates the transporter 242 with the liquid ejecting head mounted. The invention is not limited to such a mode. The liquid ejecting apparatuses may be line-type liquid ejecting apparatuses each of which includes a plurality of nozzles N across the entire width of the medium 12.

Figure 17:
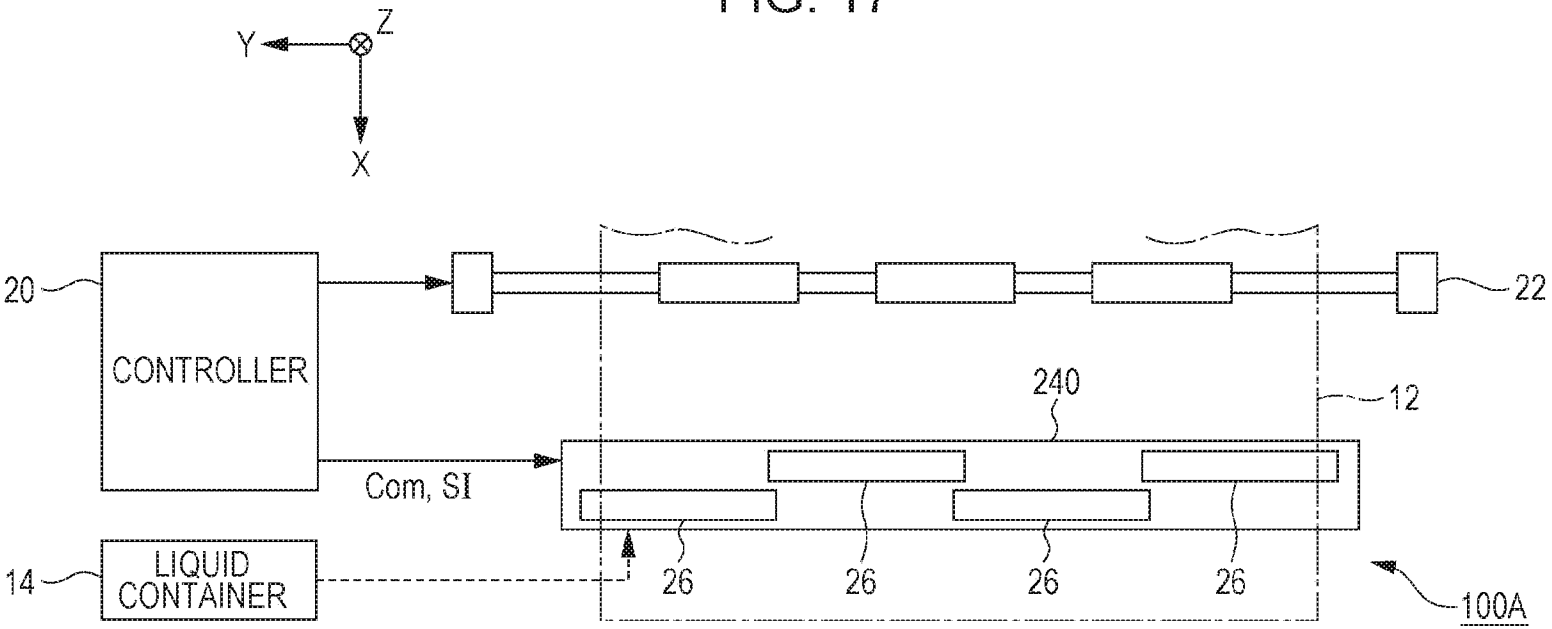
FIG. 17 is a configuration diagram of a liquid ejecting apparatus according to Modification 3.

FIG. 17 is a diagram illustrating an example of the configuration of a liquid ejecting apparatus 100A according to modification 3. The liquid ejecting apparatus 100A includes the liquid container 14, the controller 20, the transporting mechanism 22, the plurality of liquid ejecting heads 26, and a mounting mechanism 240 on which the plurality of liquid ejecting heads 26 are mounted. The liquid ejecting apparatus 100A according to modification 3 includes the same configuration as that of the liquid ejecting apparatus 100 (illustrated in FIG. 1) in not including the endless belt 244 and including the mounting mechanism 240 instead of the transporter 242. In the liquid ejecting apparatus 100A, the transporting mechanism 22 transports the medium 12 in the +X direction. In the mounting mechanism 240 included in the liquid ejecting apparatus 100A, the plurality of liquid ejecting heads 26 elongated in the Y-axis direction are distributed across the entire width of the medium 12. In the mounting mechanism 240, the liquid ejecting heads 26A, 26B, 26C, and 26D may be mounted instead of the liquid ejecting head 26.

Modification 4

In the configurations illustratively shown in the aforementioned embodiments and modifications, the vibration absorbers 46 and 54 are both provided. However, when fluctuations in the pressure within the reservoirs do not cause a particular problem, for example, one or both of the vibration absorbers 46 and 54 can be omitted. The liquid ejecting heads employing the configuration in which one or both of the vibration absorbers 46 and 54 are omitted can be manufactured at lower cost than those employing the configuration in which both of the vibration absorbers 46 and 54 are provided.

Modification 5

In the aforementioned embodiments and modifications, the piezoelectric elements 37 are illustratively shown as the elements (driving elements) that apply pressure within the pressure chambers C (or pressure chambers CB). However, the invention is not limited to such a mode. For example, the driving elements can be heat generating elements which are heated to generate bubbles within the pressure chambers for changing the pressure within the pressure chambers. Each heat generating elements includes a heat generator which generates heat upon supply of the drive signal. As understood from the above-described examples, the driving elements are collectively represented as elements that eject liquid within the pressure chambers through the nozzles N (typically elements that apply pressure within the pressure chambers). Any operation type (piezoelectric/thermal type) and any configurations are available.

Modification 6

Each of the liquid ejecting apparatuses illustratively shown in the above embodiments and modifications is applicable to various types of devices such as facsimile and copying devices in addition to devices for printing. Moreover, The applications of the liquid ejecting apparatus of the present invention are not limited to printing. Liquid ejecting apparatuses which eject solvents of color materials are used as manufacturing apparatuses to form color filters for liquid-crystal display apparatuses, for example. Liquid ejecting apparatuses which eject solutions of conducting materials are used as manufacturing apparatuses to form wires and electrodes of wiring substrates.

What is claimed is:

1. A liquid ejecting head comprising:
an ejecting section including:
a pressure chamber filled with liquid;
a communicating flow channel communicating with a nozzle which ejects the liquid filling the pressure chamber;
a vibration plate constituting the wall surface of the pressure chamber; and
a piezoelectric element driven with a drive signal;
a circuit substrate provided above the ejecting section;
a switch circuit which is provided on the circuit substrate and switches between supply and shut-off of the drive signal to the piezoelectric element; and
a reserve chamber which reserves the liquid so that the liquid is supplied from the reserve chamber to the pressure chamber, wherein
at least a part of the switch circuit is located between the piezoelectric element and the reserve chamber,
the piezoelectric element is provided in a sealed space defined by a plurality of members including the circuit substrate,
the pressure chamber includes:
an inlet port allowing the liquid within the reserve chamber to flow into the pressure chamber;
an outlet port allowing the liquid within the pressure chamber to flow to the reserve chamber; and
a supply port allowing the liquid within the pressure chamber to be supplied to the communicating flow channel.

2. The liquid ejecting head according to claim 1, wherein
the reserve chamber includes:
a first flow channel which causes the liquid to flow into the pressure chamber through the inlet port; and
a second flow channel which collects the liquid flowed out through the outlet port, wherein
the second flow channel communicates with the first flow channel.

3. The liquid ejecting head according to claim 2, comprising a plurality of the nozzles, wherein
the plurality of nozzles include a first nozzle and a second nozzle located on the opposite side of the second flow channel from the first nozzle in a plan view.

4. The liquid ejecting head according to claim 1, wherein
at least a part of the circuit substrate is provided between the reserve chamber and the pressure chamber.

5. The liquid ejecting head according to claim 1, comprising a plurality of the nozzles, wherein
the plurality of nozzles are provided at a density of 300 nozzles or more per inch.

6. The liquid ejecting head according to claim 1, wherein
the piezoelectric element is driven so that the liquid filling the pressure chamber is ejected through the nozzle 30000 times or more per second.

7. The liquid ejecting head according to claim 1, wherein
the cross-sectional area of the inlet port is larger than the cross-sectional area of the outlet port.

8. The liquid ejecting head according to claim 1, wherein
at least a part of the reserve chamber overlaps both of at least a part of the piezoelectric element and at least a part of the switch circuit in a plan view.

9. The liquid ejecting head according to claim 1, comprising:
a plurality of the piezoelectric elements; and
a wire member which is provided at an end of the circuit substrate in a direction where the plurality of piezoelectric elements are arranged and is electrically connected to the switch circuit.

10. The liquid ejecting head according to claim 1, wherein
the switch circuit generates heat when switching between supply and shut-off of the drive signal to the piezoelectric element, and
the circuit substrate is provided so that heat generated in the switch circuit propagates to the liquid within the pressure chamber.

11. The liquid ejecting head according to claim 1, wherein
when the piezoelectric element is driven,
the temperature of the switch circuit is higher than the temperature of the liquid within the pressure chamber, and heat in the switch circuit propagates to the liquid within the pressure chamber to reduce an increase in the temperature of the switch circuit.

12. A liquid ejecting apparatus, comprising the liquid ejecting head according to claim 1.

13. The liquid ejecting head according to claim 1, wherein the circuit substrate overlaps the inlet port, the outlet port, and the supply port in a plan view.

14. The liquid ejecting head according to claim 1, further comprising a housing defining an internal opening corresponding to the reserve chamber, and a recess spaced apart from the internal opening, wherein at least the circuit substrate and the switch circuit are accommodated within the recess of the housing.

15. A liquid ejecting head comprising:

a first pressure chamber filled with liquid;

a second pressure chamber filled with the liquid;

a reserve chamber which reserves the liquid so that the liquid is supplied from the reserve chamber to the first pressure chamber and the second pressure chamber;

a first connecting flow channel which has one end communicating with the first pressure chamber and the other end communicating with the reserve chamber;

a second connecting flow channel which has one end communicating with the second pressure chamber and the other end communicating with the reserve chamber;

a link flow channel which has one end communicating with the first pressure chamber and the other end communicating with the second pressure chamber;

a nozzle which ejects the liquid filling the first pressure chamber;

a vibration plate constituting the wall surface of the first pressure chamber;

a piezoelectric element driven with a drive signal;

a circuit substrate provided on the vibration plate; and a switch circuit which is provided on the circuit substrate and switches between supply and shut-off of the drive signal to the piezoelectric element, wherein at least a part of the switch circuit is located between the piezoelectric element and the reserve chamber, and the piezoelectric element is provided in a sealed space defined by a plurality of members including the circuit substrate.

16. A liquid ejecting apparatus, comprising the liquid ejecting head according to claim 15.

* * * * *